US011046551B2

(12) United States Patent
Troxel

(10) Patent No.: US 11,046,551 B2
(45) Date of Patent: Jun. 29, 2021

(54) CORE MEMBER FOR A FILM ROLL

(71) Applicant: Fuji Seal International, Inc., Osaka (JP)

(72) Inventor: Zachariah Jefferson Troxel, Bardstown, KY (US)

(73) Assignee: Fuji Seal International, Inc.

( * ) Notice: Subject to any disclaimer, the term of this patent is extended or adjusted under 35 U.S.C. 154(b) by 269 days.

(21) Appl. No.: 16/128,668

(22) Filed: Sep. 12, 2018

(65) Prior Publication Data

US 2020/0079613 A1 Mar. 12, 2020

(51) Int. Cl.

| | |
|---|---|
| ***B65H 75/02*** | (2006.01) |
| ***B65H 18/28*** | (2006.01) |
| ***B65H 75/44*** | (2006.01) |
| ***B65H 18/10*** | (2006.01) |

(52) U.S. Cl.

CPC ..... *B65H 75/025* (2013.01); *B65H 18/28* (2013.01); *B65H 18/103* (2013.01); *B65H 75/4476* (2013.01); *B65H 2301/412845* (2013.01); *B65H 2701/1846* (2013.01)

(58) Field of Classification Search

CPC .. B65H 75/025; B65H 18/28; B65H 75/4476; B65H 2301/412845; B65H 2701/1846; B65H 18/103; B65H 2701/534; B65H 75/12; B65H 75/22; B65H 75/30; B65H 75/24; B65H 18/106; B65H 75/02; B65H 75/146

USPC ..... 242/603

See application file for complete search history.

(56) References Cited

U.S. PATENT DOCUMENTS

| | | | | |
|---|---|---|---|---|
| 142,073 | A * | 8/1873 | Bates | B65D 85/672 206/391 |
| 867,142 | A * | 9/1907 | Kuensting | B30B 9/3042 100/100 |
| 1,926,836 | A * | 9/1933 | Corlett | A01K 97/16 242/118.4 |
| 2,658,695 | A | 11/1953 | Atchason | |
| 3,039,226 | A * | 6/1962 | Bagdonas | A01K 97/06 43/57.2 |
| 4,569,491 | A * | 2/1986 | Kauffman | B65H 75/146 242/118.41 |
| 4,583,315 | A * | 4/1986 | Schreck | A01K 89/00 43/54.1 |
| 6,296,118 | B1 * | 10/2001 | Speck | B65H 75/16 206/408 |

(Continued)

FOREIGN PATENT DOCUMENTS

| | | |
|---|---|---|
| CN | 206 798 827 U | 12/2017 |
| DE | 19 49 665 A1 | 4/1971 |

(Continued)

OTHER PUBLICATIONS

International Search Report and Written Opinion dated Jan. 27, 2020 for Application No. PCT/IB2019/001007, 12 pgs.
U.S. Appl. No. 16/275,481.

*Primary Examiner* — William A. Rivera
(74) *Attorney, Agent, or Firm* — Frost Brown Todd LLC

(57) ABSTRACT

A core member is provided for storing shrink film. The core member includes a plurality of rollers, each having a disc and a core extending upwardly from the disc. The plurality of rollers are aligned longitudinally along an axis and laterally along a plane. The plurality of rollers are rotatable to wind the shrink film about the rollers.

18 Claims, 27 Drawing Sheets

(56) References Cited

U.S. PATENT DOCUMENTS

| | | | | |
|---|---|---|---|---|
| 6,702,212 | B2 | 3/2004 | Abba et al. | |
| 6,802,467 | B2 | 10/2004 | Abba et al. | |
| 10,053,321 | B2 | 8/2018 | Erdem et al. | |
| 10,087,027 | B2 | 10/2018 | Takeda et al. | |
| 10,554,025 | B2 * | 2/2020 | Fowler, Jr. ..... | H02G 1/08 |
| 2004/0232273 | A1 | 11/2004 | Arai et al. | |

FOREIGN PATENT DOCUMENTS

| | | | |
|---|---|---|---|
| JP | S57-141962 | U | 9/1982 |
| JP | H 05-21816 | B2 | 3/1993 |

* cited by examiner

CORE MEMBER FOR A FILM ROLL

TECHNICAL FIELD

The disclosed embodiments generally pertain to a core member for a film roll, and in particular to a core member for storing an elongated sheet of heat shrink film.

BACKGROUND

Generally, elongated sheets of heat shrink film may be manufactured and wound onto a core member such that the roll of heat shrink film on the core member may be transported from the manufacturing facility to a customer. The customer may then unwind the heat shrink film from the core member for use. For instance, as shown in FIGS. 1 and 2, an elongated sheet of film (12) has been wound around a core member (10) to form a roll (14). Each core member (10) may comprise an inner core (11) extending upwardly from a central portion of a disc (13), as shown in FIG. 2. Accordingly, an end of the elongated sheet of film (12) may be attached to a side wall of the inner core (11) and wound around the inner core (11) such that as the film (12) is wound, the film (12) expands outwardly to rest on a top surface of the disc (13). Once wound, each roll (14) typically may comprise about 1,000 meters of film (12) on one core member (10).

Each roll (14) may then be placed on a pallet (6), within a compartment (4) of a container (2), for transporting to a customer, as shown in FIG. 1. Typically, four rolls (14) of film (12) may be placed adjacent to each other on the pallet (6) to form a layer (8). Additional layers (8) of rolls (14) may then be placed on top of each other on the pallet (6). This may allow the pallet (6) to hold up to about 4,000 meters of film (12) per layer (8) and about 16,000 to about 50,400 meters of film (12) per pallet (6). To form a layer (8) of four rolls (14) of film (12), three splices may be made to cut the elongated sheet of film (12) three times to wind the film (12) onto the four different core members (10). Accordingly, nine splices may be made to run about 10,000 meters of film (12). During the winding process, the average rate of speed the film (12) is winding onto a core member (10) may be about 175 meters per minute and the amount of time to wind the film (12) onto the core member (10) may be about 5.7 minutes. Accordingly, the amount of time to unwind film (12) from a slit roll containing about 10,000 meters of film (12), splice the film (12), and wind the film (12) onto a plurality of core members (10) is about 57 minutes. It may therefore be desirable to provide a core member that is able to hold more film with fewer splices and more efficiently wind the film onto the core member.

While a variety of core members for film rolls have been made and used, it is believed that no one prior to the inventors has made or used an invention as described herein.

SUMMARY

In some instances, it may be desirable to provide a core member comprising a plurality of rollers to allow a single core member to hold more film and/or more efficiently wind the film about the core member. In some versions, the core member may expandable and/or collapsible for easier transport. Such core members are described in more detail below.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
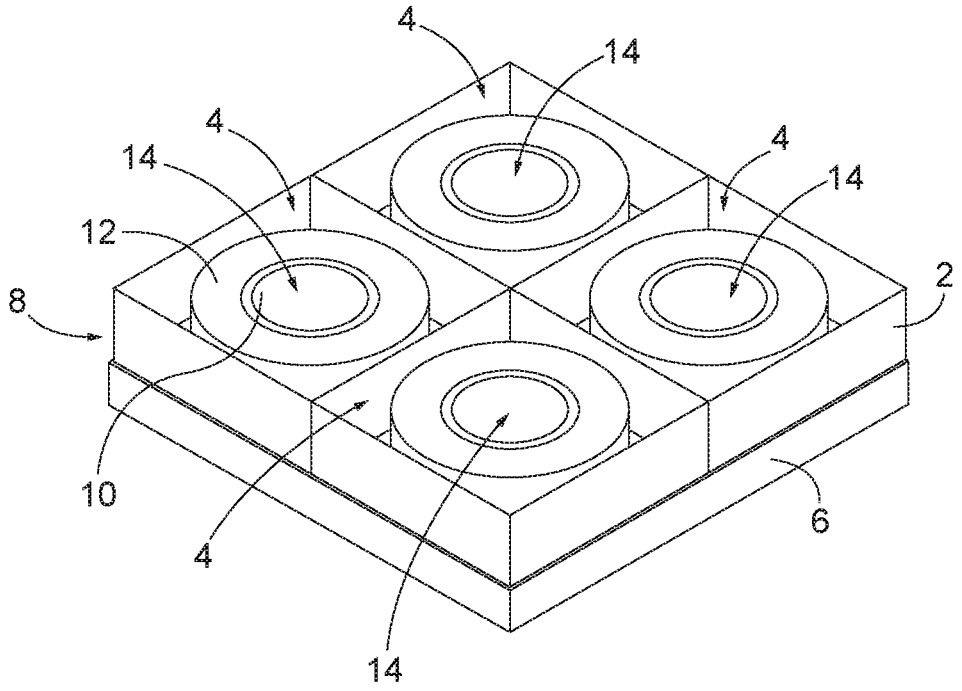
FIG. 1 (PRIOR ART)
FIG. 1 depicts a top perspective view of a plurality of prior art core members wound with elongated sheets of film and stored on a pallet.
Figure 2:
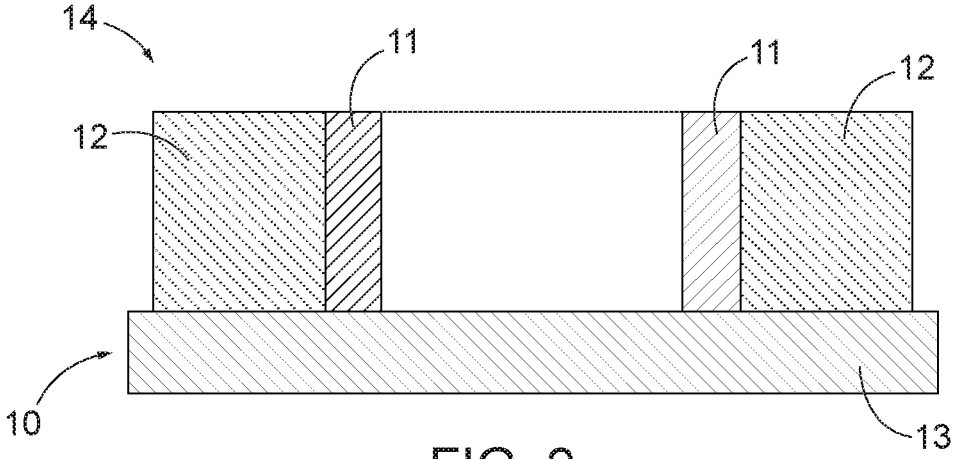
FIG. 2 (PRIOR ART)
FIG. 2 depicts a cross-sectional view of the prior art core member of FIG. 1 wound with film.
Figure 3:
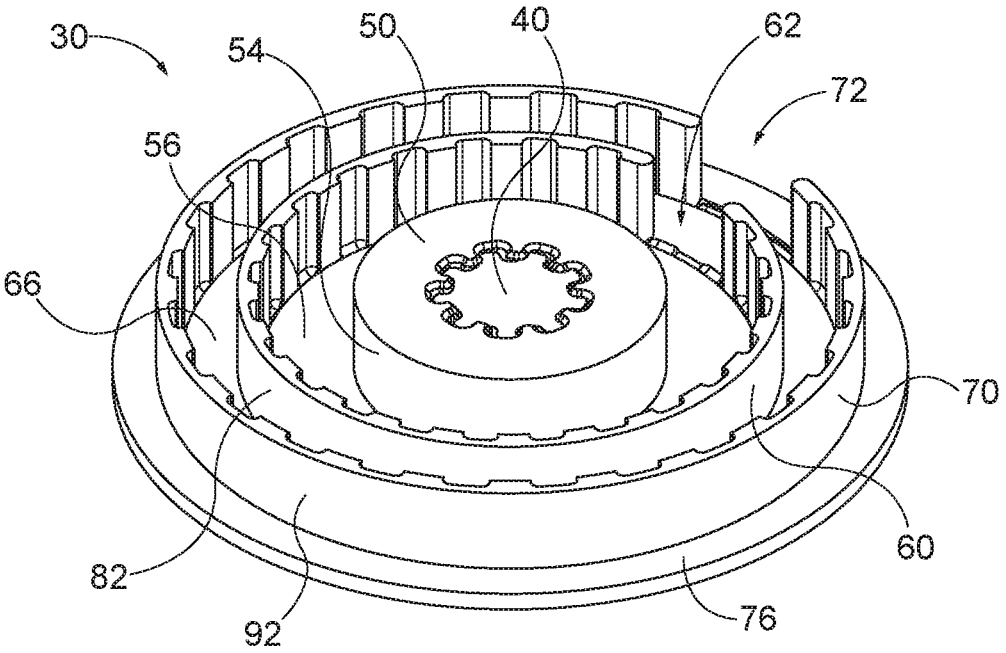
FIG. 3 depicts a top perspective view of an embodiment of a core member comprising a plurality of rollers, with a gear inserted within the core member.
Figure 4:
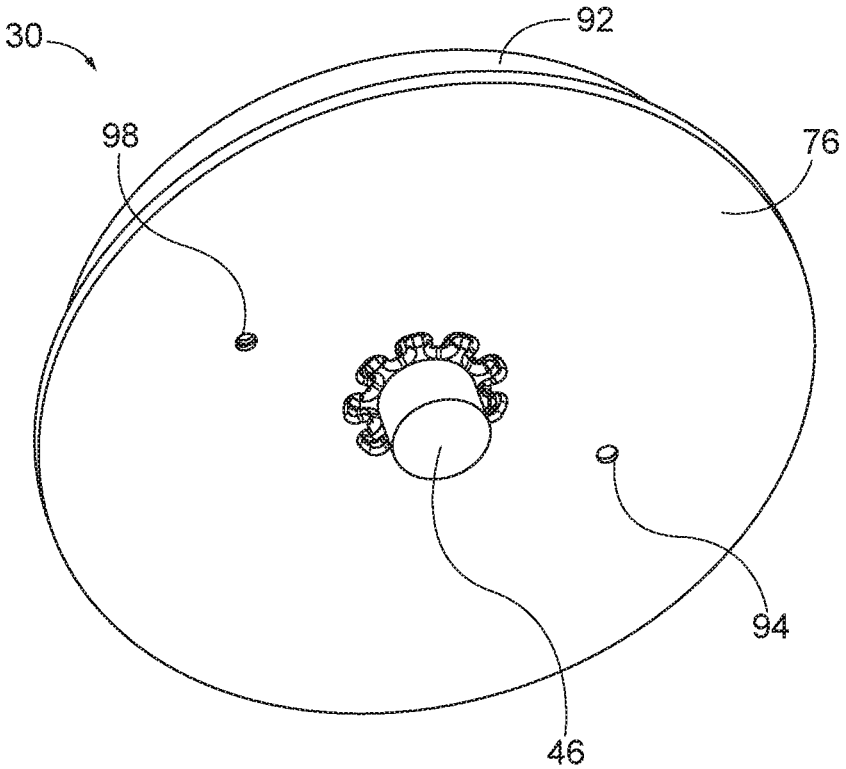
FIG. 4 depicts a bottom perspective view of the core member of FIG. 3, with the gear inserted within the core member.
Figure 5:
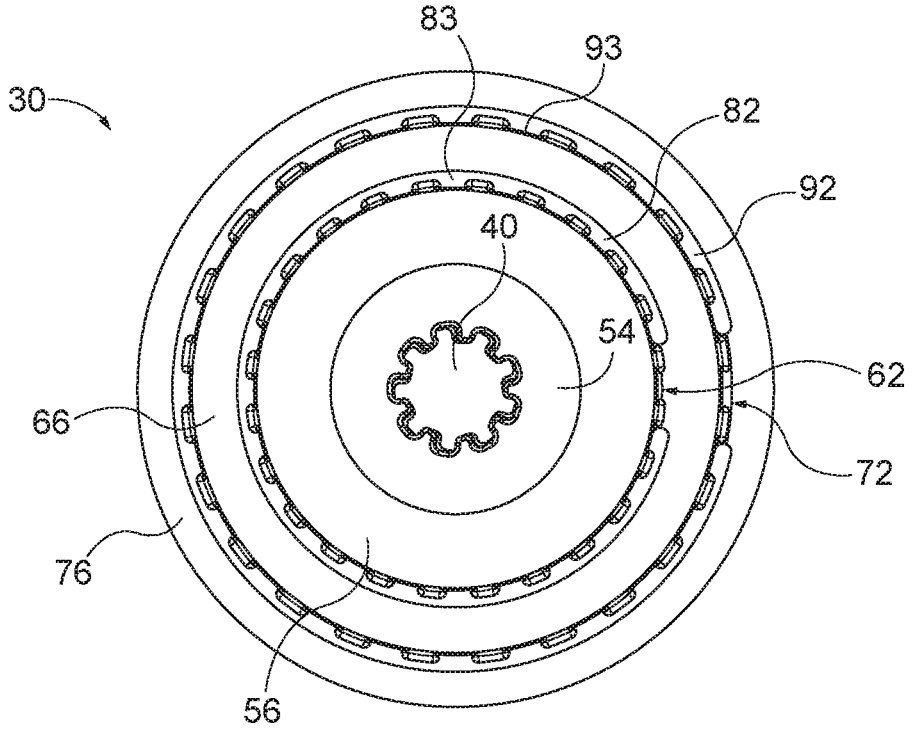
FIG. 5 depicts a top plan view of the core member of FIG. 3, with the gear inserted within the core member.
Figure 6:
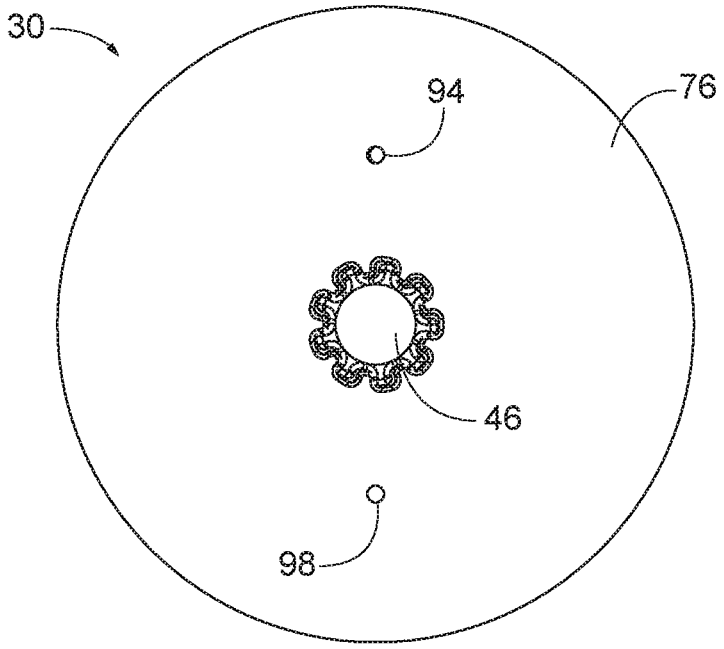
FIG. 6 depicts a bottom plan view of the core member of FIG. 3, with the gear inserted within the core member.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. A Core Member Comprising a Plurality of Rollers

Figure 7:
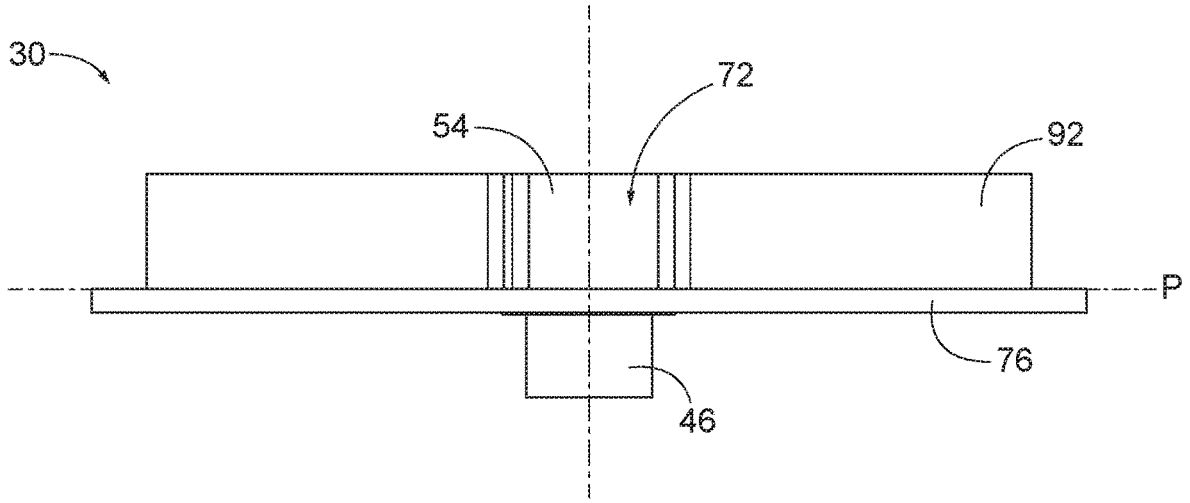
FIG. 7 depicts a front view of the core member of FIG. 3, with the gear inserted within the core member.
Figure 8:
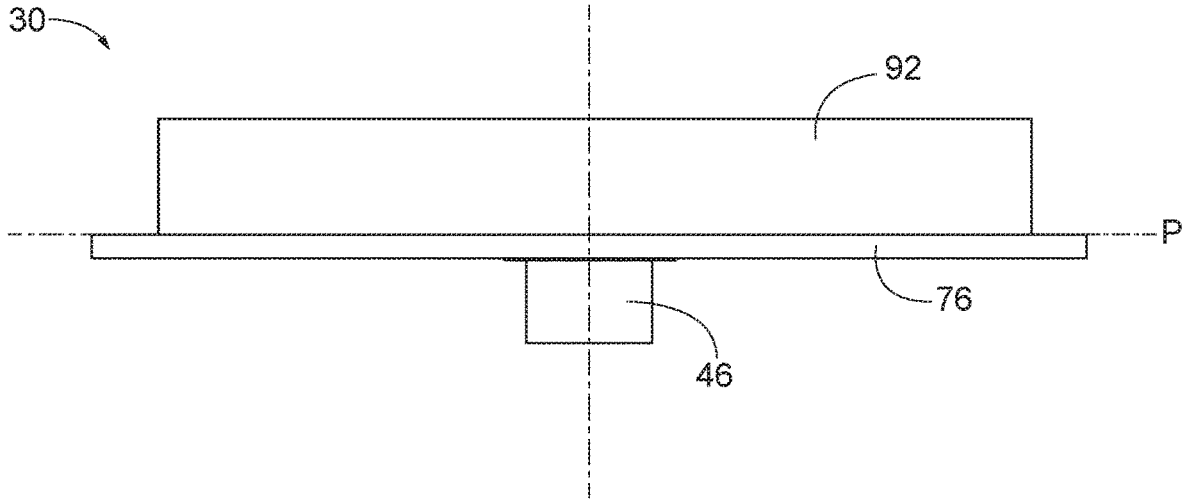
FIG. 8 depicts a rear view of the core member of FIG. 3, with the gear inserted within the core member.
Figure 9:
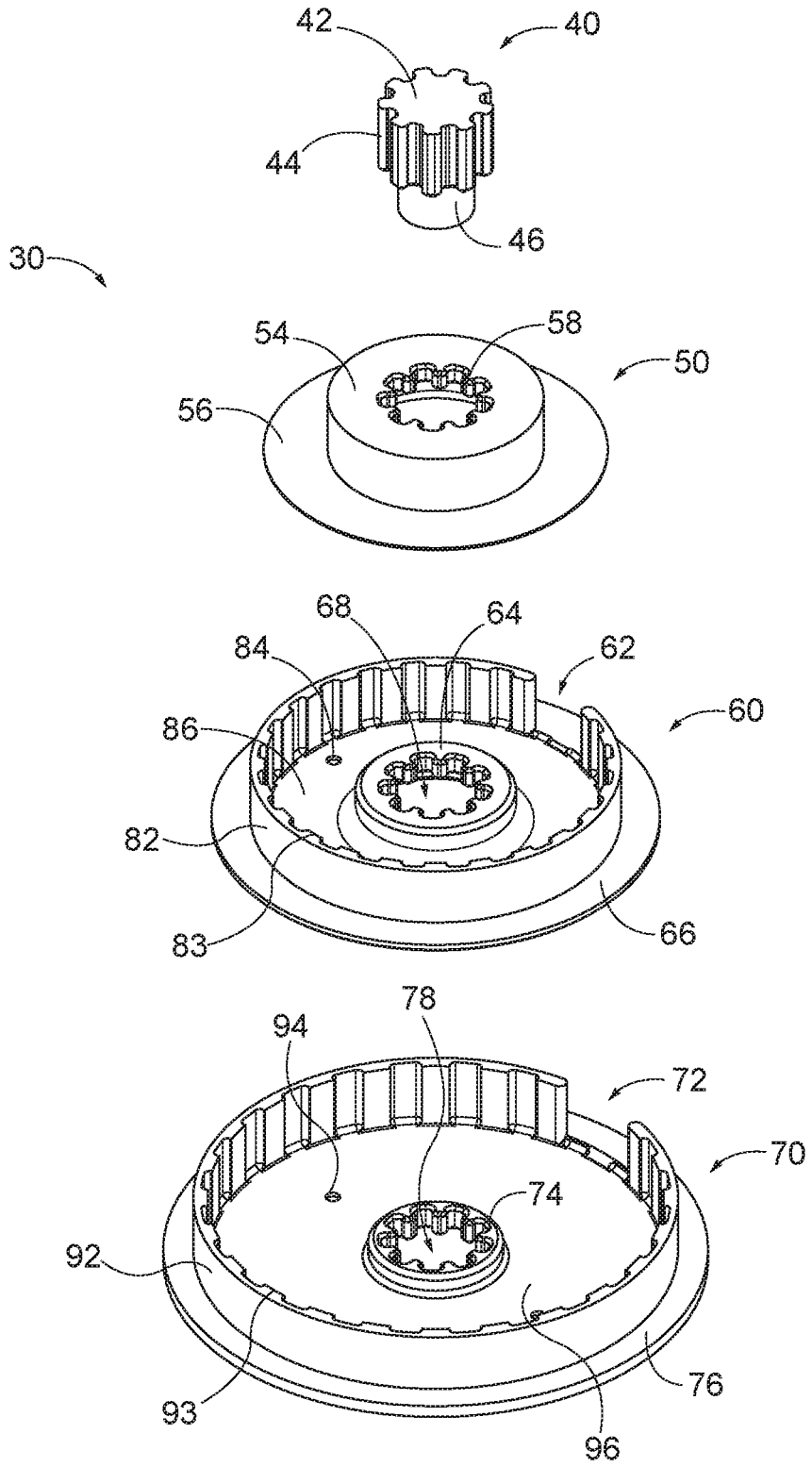
FIG. 9 depicts an exploded top perspective view of the core member of FIG. 3, shown with the gear.
Figure 10:
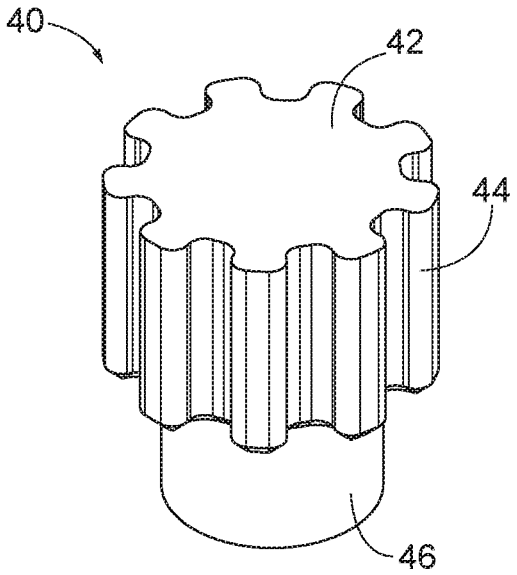
FIG. 10 depicts a top perspective view of a gear for use with the core member of FIG. 3.
Figure 11:
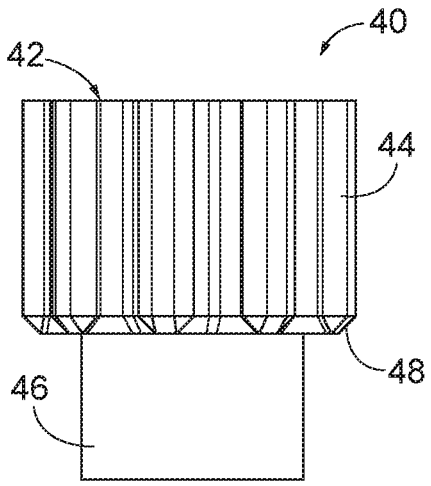
FIG. 11 depicts a side elevational view of the gear of FIG. 10.
Figure 12:
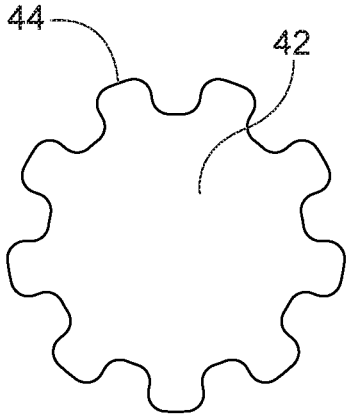
FIG. 12 depicts a top plan view of the gear of FIG. 10.
Figure 13:
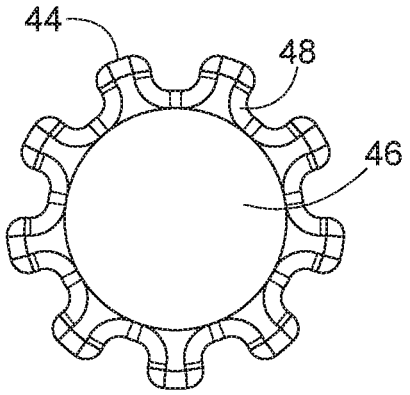
FIG. 13 depicts a bottom plan view of the gear of FIG. 10.
Figure 14:
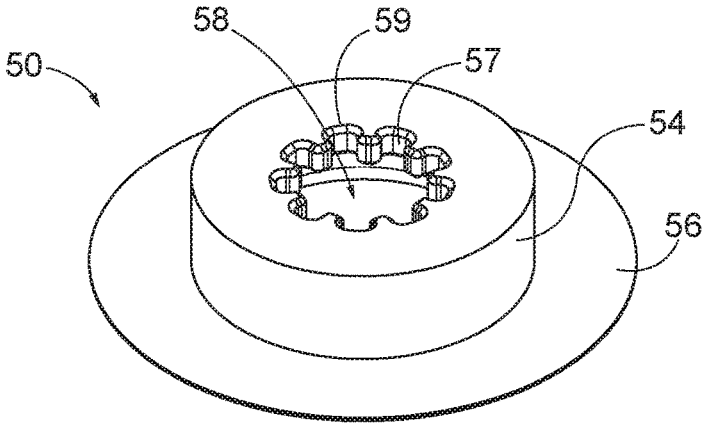
FIG. 14 depicts a top perspective view of an inner roller of the core member of FIG. 3.
Figure 15:
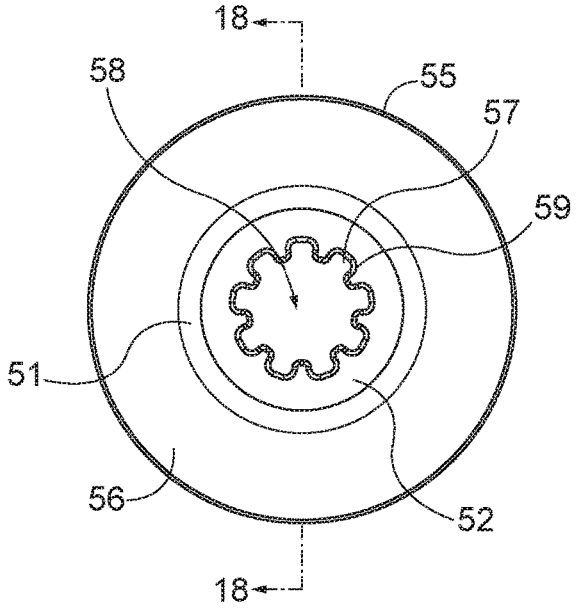
FIG. 15 depicts a bottom plan view of the inner roller of FIG. 14.
Figure 16:
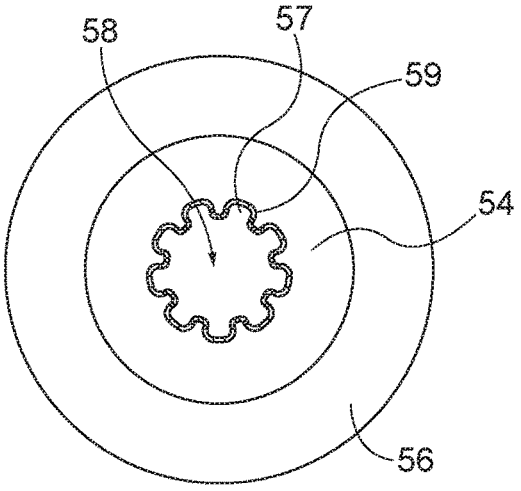
FIG. 16 depicts a top plan view of the inner roller of FIG. 14.
Figure 17:
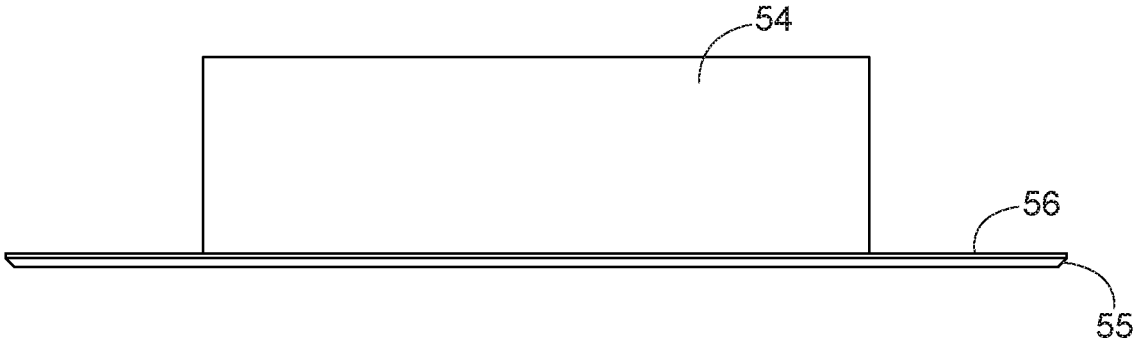
FIG. 17 depicts a side elevational view of the inner roller of FIG. 14.

Referring to FIGS. 3-9, a core member (30) is shown comprising an inner roller (50), an intermediate roller (60), and an outer roller (70). In the illustrated embodiment, the inner roller (50) is nested within the intermediate roller (60), which is nested within the outer roller (70). Accordingly, the rollers (50, 60, 70) are concentrically aligned along a longitudinal axis (A), as best seen in FIGS. 7-8. A gear (40) may then be positioned within the rollers (50, 60, 70), along the axis (A), for winding and/or unwinding film from the core member (30).

Each roller (50, 60, 70) of the core member (30) may be made from a plastic, a polymer, or other suitable material. In some versions, each roller (50, 60, 70) may be injection molded and assembled together to form the core member (30). Accordingly, each roller (50, 60, 70) may rotate relative to each other about the longitudinal axis (A). In some other versions, the rollers (50, 60, 70) may be manufactured as an integral core member (30). Still other suitable configurations for the core member (30) will be apparent to one with ordinary skill in the art in view of the teachings herein. For instance, while the illustrated embodiment shows the core member (30) comprising three rollers (50, 60, 70), any other suitable number of rollers may be used.

The gear (40) may be inserted within the core member (30) to rotate the rollers (50, 60, 70) for winding and/or unwinding the film from the core member (30). As shown in FIGS. 10-13, the gear (40) comprises a head (42) and a shaft (46) extending from the head (42). The head (42) comprises a plurality of teeth (44) extending outwardly about the head (42). The lower portion of the head (42) comprises a chamfered wall (48) extending inwardly toward the shaft (46). The chamfered wall (48) may thereby be configured to guide the gear (40) into the inner roller (50). The shaft (46) of the gear (40) may be coupled with a seamer, or other suitable machine, to rotate the gear (40) for winding and/or unwinding film from the core member (30). Still other suitable configurations for the gear (40) will be apparent to one with ordinary skill in the art in view of the teachings herein.

Figure 18:
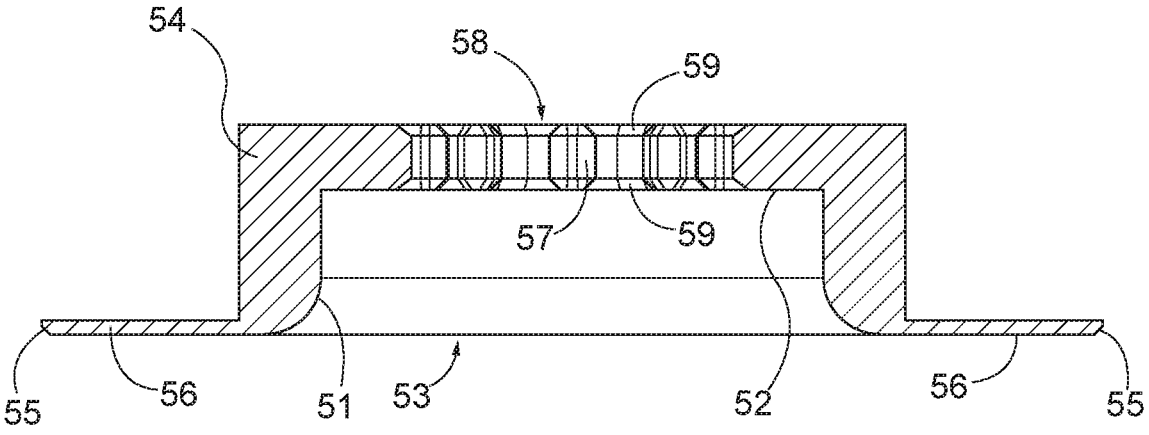
FIG. 18 depicts a cross-sectional view of the inner roller of FIG. 14 taken along line 18-18 of FIG. 15.
Figure 19:
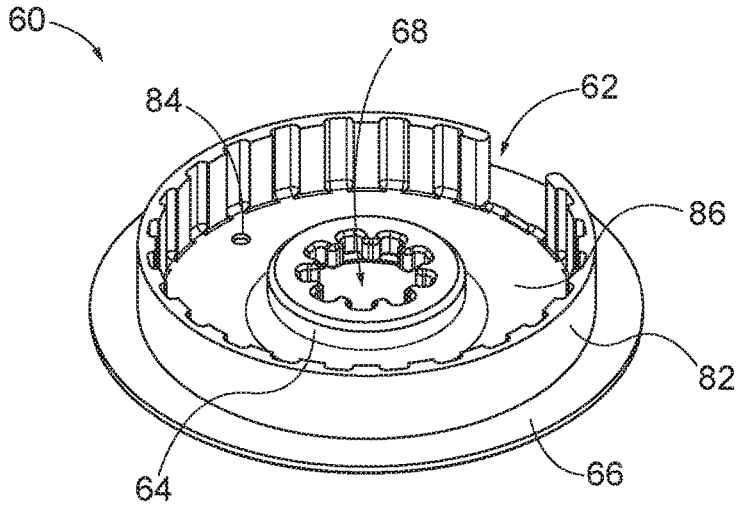
FIG. 19 depicts a top perspective view of an intermediate roller of the core member of FIG. 3.

Referring to FIGS. 14-18, the inner roller (50) comprises a core (54) extending upwardly from a central portion of a disc (56) such that the disc (56) is positioned around a bottom portion of the core (54). The core (54) defines an upper opening (58) through a central portion of the core (54) having a plurality of recesses (57). The recesses (57) may correspond with the teeth (44) of the gear (40) such that the teeth (44) may be inserted within the recesses (57). In the illustrated embodiment, the top portion and the bottom portion of the upper opening (58) comprises a chamfer (59) that may be configured to guide the gear (40) into the opening (58). As best seen in FIG. 18, the chamfer (59) at the bottom portion of the upper opening (58) is coupled with a lower opening (53) having a larger diameter to form a shelf (52) within the core (54) between the upper opening (58) and the lower opening (53). A curved wall (51) is then formed between the bottom surface of the disc (56) and the lower opening (53). The bottom surface of the disc (56) may further comprise a chamfer (55) extending inwardly to the bottom surface of the disc (56). Such a chamfer (55) may guide the disc (56) into the intermediate roller (60). Still other suitable configurations for the inner roller (50) will be apparent to one with ordinary skill in the art in view of the teachings herein.

The intermediate roller (60) of the core member (30) is shown in more detail in FIGS. 19-23. The intermediate roller (60) comprises a core (64), an inner disc (86), an annular flange (82), and an outer disc (66). In the illustrated embodiment, the inner disc (86) is positioned between the core (64) and the annular flange (82) such that the core (64) extends upwardly from an inner portion of the inner disc (86) and the annular flange (82) extends upwardly from an outer portion of the inner disc (86). The outer disc (66) then extends outwardly from a bottom portion of the annular flange (82). In the illustrated embodiment, the core (64) of the intermediate roller (60) has a lower height than the core (54) of the inner roller (50) such that the core (64) of the intermediate roller (60) may be positioned within the core (54) of the inner roller (50). The outer surface of the core (64) of the intermediate roller (60) may further comprise a chamfer (85) configured to guide the core (64) into the lower opening (53) of the core (54) of the inner roller (50). Accordingly, the core (64) of the intermediate roller (60) is sized to correspond with the lower opening (53) of the inner roller (50) such that the outer top surface of the core (64) of the intermediate roller (60) is positioned adjacent to the shelf (52) of the inner roller (50). In the illustrated embodiment, the outer diameter of the core (64) of the intermediate roller (60) is slightly smaller than the inner diameter of the lower opening (53) of the inner roller (50) such that the core (64) may rotate within the lower opening (53) to allow the inner and intermediate rollers (50, 60) to rotate relative to each other about the longitudinal axis (A).

Figure 20:
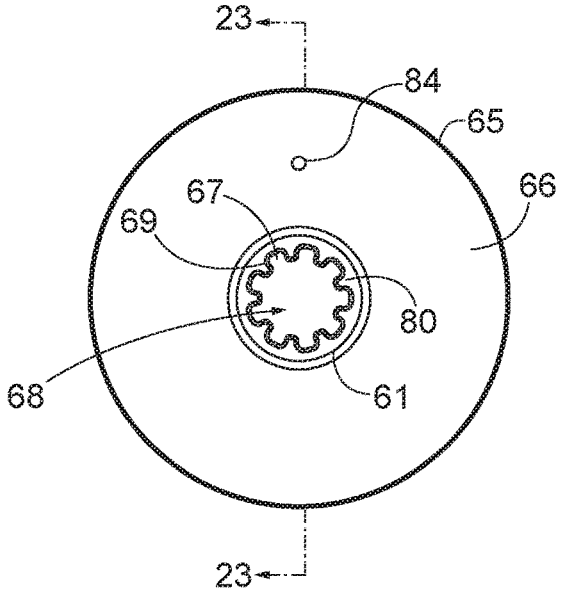
FIG. 20 depicts a bottom plan view of the intermediate roller of FIG. 19.
Figure 21:
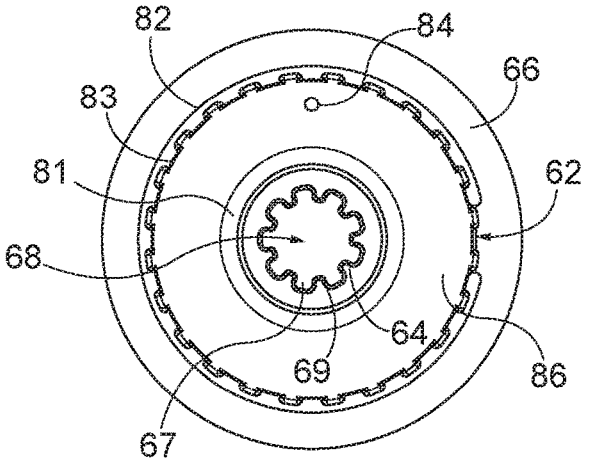
FIG. 21 depicts a top plan view of the intermediate roller of FIG. 19.
Figure 23:
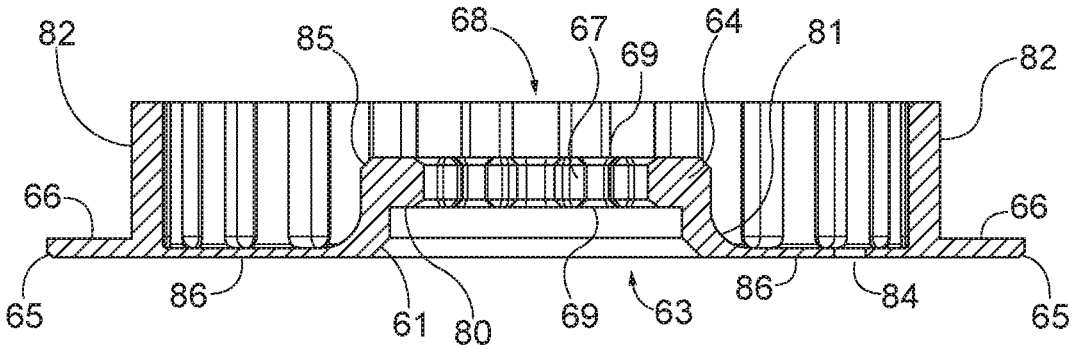
FIG. 23 depicts a cross-sectional view of the intermediate roller of FIG. 19 taken along line 23-23 of FIG. 20.
Figure 24:
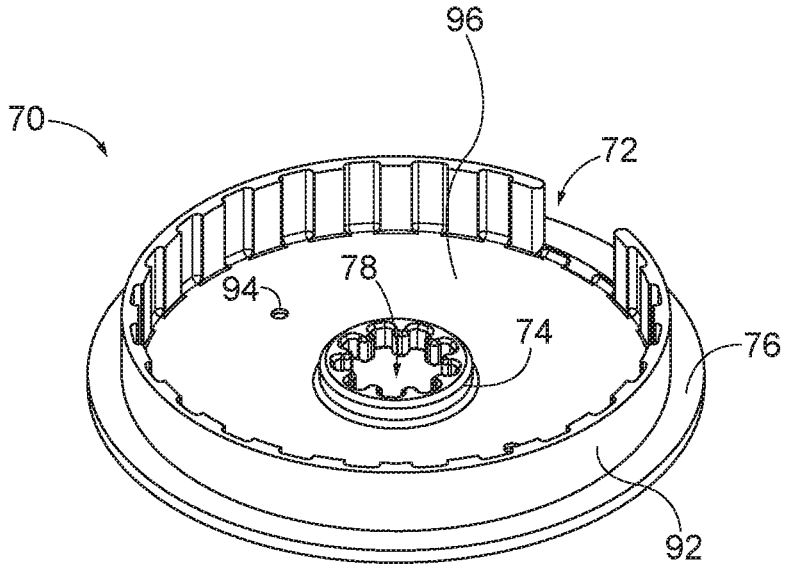
FIG. 24 depicts a top perspective view of an outer roller of the core member of FIG. 3.

As best seen in FIGS. 20-21, the core (64) of the intermediate roller (60) defines an upper opening (68) through a central portion of the core (64) having a plurality of recesses (67). The recesses (67) may correspond with the teeth (44) of the gear (40) such that the teeth (44) may be inserted within the recesses (67). In the illustrated embodiment, the top portion and the bottom portion of the upper opening (68) comprises a chamfer (69) that may be configured to guide the gear (40) into the opening (68). As best seen in FIG. 23, the chamfer (69) at the bottom portion of the upper opening (68) is coupled with a lower opening (63) having a larger diameter to form a shelf (80) within the core (64) between the upper opening (68) and the lower opening (63). A bottom curved wall (61) is then formed between the bottom surface of the inner disc (86) and the lower opening (63). A top curved wall (81) may also be formed between the top surface of the inner disc (86) and the side wall of the core (64). The inner disc (86) also comprises an opening (84) through the inner disc (86) from the top surface of the inner disc (86) to the bottom surface of the inner disc (86). Accordingly, a first pin may be aligned with the opening (84) of the inner disc (86) to maintain the position of the intermediate roller (60) to thereby selectively prevent the intermediate roller (60) from rotating about the longitudinal axis (A). The pin can be a solenoid or the like.

Figure 22:
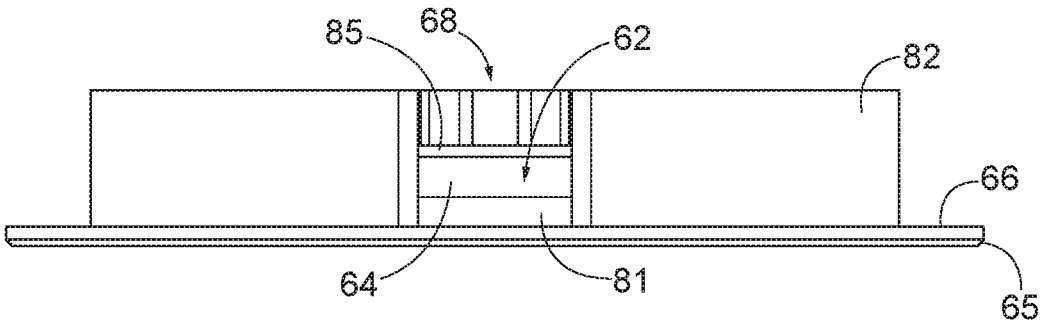
FIG. 22 depicts a side elevational view of the intermediate roller of FIG. 19.

The size of the inner disc (86) from the outer surface of the core (64) to the inner surface of the annular flange (82) may be sized to correspond to the disc (56) of the inner roller (50) such that the top surface of the inner disc (86) is configured to receive the bottom surface of the disc (56) of the inner roller (50). In the illustrated embodiment, the outer diameter of the disc (56) of the inner roller (50) is slightly smaller than the inner diameter of the annular flange (82) to allow the inner roller (50) to rotate relative to the intermediate roller (60). The annular flange (82) of the illustrated embodiment further comprises a plurality of teeth (83) extending inward from the flange (82) that may provide additional support for the annular flange (82). A recess (62) is defined through the side wall of the annular flange (82) such that film may be inserted through the recess (62). The outer disc (66) then extends outwardly from the annular flange (82) such that the bottom surface of the outer disc (66) is aligned with the bottom surface of the inner disc (86). As best seen in FIGS. 22-23, the bottom edge of the outer disc (66) may further comprise a chamfer (65) extending inwardly to the bottom surface of the outer disc (66). This may guide the intermediate roller (60) into the outer roller (70). The outer disc (66) may have a greater thickness than the inner disc (86) such that a top surface of the outer disc (66) is aligned with the top surface of the disc (56) of the inner roller (50) when the inner roller (50) is positioned within the intermediate roller (60). Still other suitable configurations for the intermediate roller (60) will be apparent to one with ordinary skill in the art in view of the teachings herein.

The outer roller (70) of the core member (30) is shown in more detail in FIGS. 24-28. The outer roller (70) comprises a core (74), an inner disc (96), an annular flange (92), and an outer disc (76). In the illustrated embodiment, the inner disc (96) is positioned between the core (74) and the annular flange (92) such that the core (74) extends upwardly from an inner portion of the inner disc (96) and the annular flange (92) extends upwardly from an outer portion of the inner disc (96). The outer disc (76) then extends outwardly from a bottom portion of the annular flange (92). In the illustrated embodiment, the core (74) of the outer roller (70) has a lower height than the core (64) of the intermediate roller (60) such that the core (74) of the outer roller (70) may be positioned within the core (64) of the intermediate roller (60). The outer surface of the core (74) of the outer roller (70) may further comprise a chamfer (95) configured to guide the core (74) into the lower opening (63) of the core (64) of the intermediate roller (60). Accordingly, the core (74) of the outer roller (70) is sized to correspond with the lower opening (63) of the intermediate roller (60) such that the outer top surface of the core (74) of the outer roller (70) is positioned adjacent to the shelf (82) of the intermediate roller (60). In the illustrated embodiment, the outer diameter of the core (74) of the outer roller (70) is slightly smaller than the inner diameter of the lower opening (63) of the intermediate roller (60) such that the core (74) may rotate within the lower opening (63) to allow the intermediate and outer rollers (60, 70) to rotate relative to each other about the axis (A).

Figure 25:
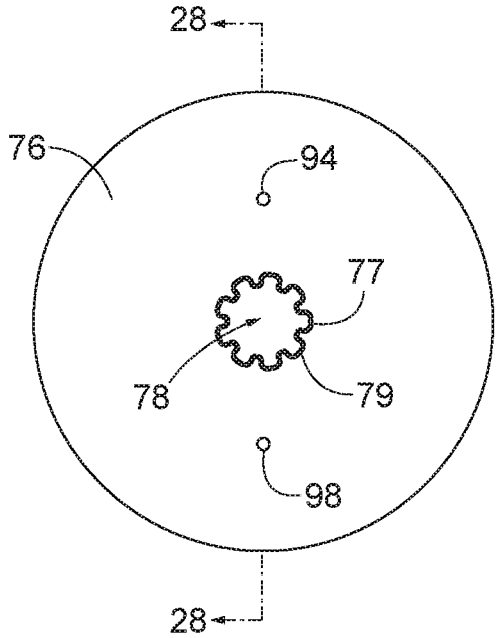
FIG. 25 depicts a bottom plan view of the outer roller of FIG. 24.
Figure 26:
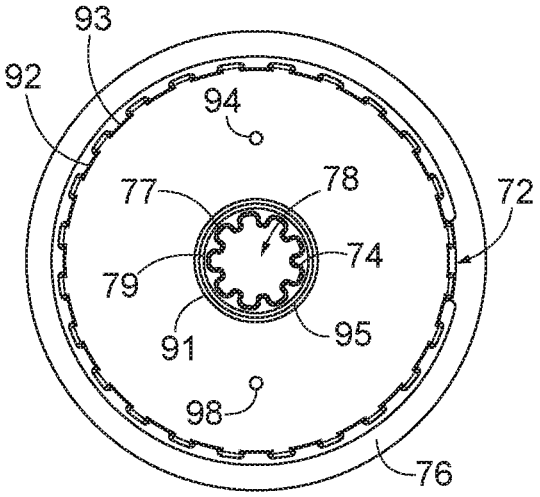
FIG. 26 depicts a top plan view of the outer roller of FIG. 24.
Figure 27:
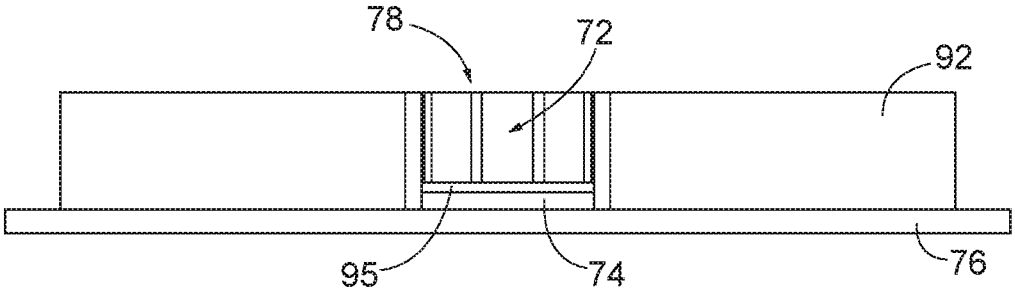
FIG. 27 depicts a side elevational view of the outer roller of FIG. 24.
Figure 28:
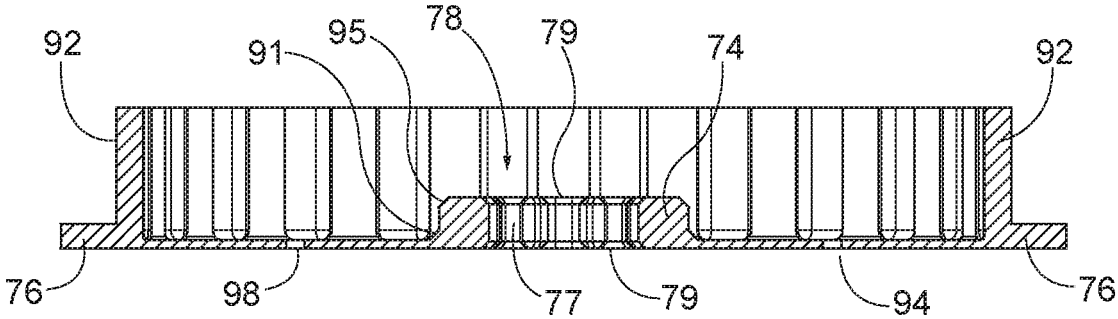
FIG. 28 depicts a cross-sectional view of the outer roller of FIG. 24 taken along line 28-28 of FIG. 25.

As best seen in FIGS. 25-26, the core (74) of the outer roller (70) defines an upper opening (78) through a central portion of the core (74) having a plurality of recesses (77). The recesses (77) may correspond with the teeth (44) of the gear (40) such that the teeth (44) may be inserted within the recesses (77). In the illustrated embodiment, the top portion and the bottom portion of the upper opening (78) comprises a chamfer (79) that may be configured to guide the gear (40) into the opening (78). A top curved wall (91) may then be formed between the top surface of the inner disc (96) and the side wall of the core (74). The inner disc (96) comprises a first opening (94) through the inner disc (96) from the top surface of the inner disc (96) to the bottom surface of the inner disc (96). The inner disc (96) further comprises a second opening (98) through the inner disc (96) from the top surface of the inner disc (96) to the bottom surface of the inner disc (96). Accordingly, the first opening (94) may be aligned with the opening (84) of the intermediate disc (60) and the first pin (or solenoid) such that the first pin may be configured to maintain the position of both the outer roller (70) and the intermediate roller (60) to prevent the rollers (60, 70) from rotating about the longitudinal axis (A). A second pin (or solenoid) may then be aligned with the second opening (98) of the inner disc (96) to maintain the position of the outer roller (70) to thereby prevent only the outer roller (70) from rotating about the axis (A).

The size of the inner disc (96) from the outer surface of the core (74) to the inner surface of the annular flange (92) may be sized to correspond to the outer disc (66) of the intermediate roller (60) such that the top surface of the inner disc (96) is configured to receive the bottom surface of the outer disc (66) of the intermediate roller (60). In the illustrated embodiment, the outer diameter of the outer disc (66) of the intermediate roller (60) is slightly smaller than the inner diameter of the annular flange (92) to allow the intermediate roller (60) to rotate relative to the outer roller (70). The annular flange (92) of the illustrated embodiment further comprises a plurality of teeth (93) extending inward from the flange (92) that may provide additional support for the annular flange (92). A recess (72) is defined through the side wall of the annular flange (92) such that film may be inserted through the recess (92). The outer disc (76) then extends outwardly from the annular flange (92) such that the bottom surface of the outer disc (76) is aligned with the bottom surface of the inner disc (96). The outer disc (76) may have a greater thickness than the inner disc (96) such that a top surface of the outer disc (76) is aligned with the top surface of the outer disc (66) of the intermediate roller (60) when the intermediate roller (60) is positioned within the outer roller (70). Still other suitable configurations for the outer roller (70) will be apparent to one with ordinary skill in the art in view of the teachings herein. The height of the core (54) and the flanges (82, 92) can be determined based on the width of the film wound on the core member (30) such that the top surfaces of the film wound on the inner, intermediate, and outer rollers (50, 60, 70) are aligned along the same plane.

Figure 29B:
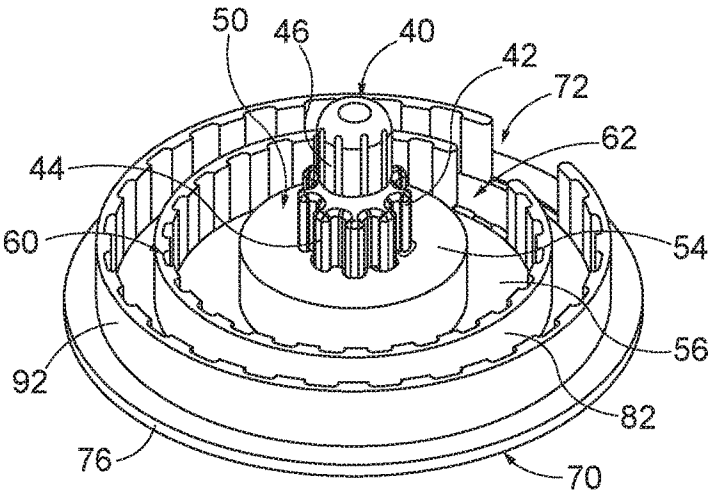
FIG. 29B depicts a top perspective view of the core member of FIG. 29A with the gear inserted within the inner roller in an upper position.
Figure 29A:
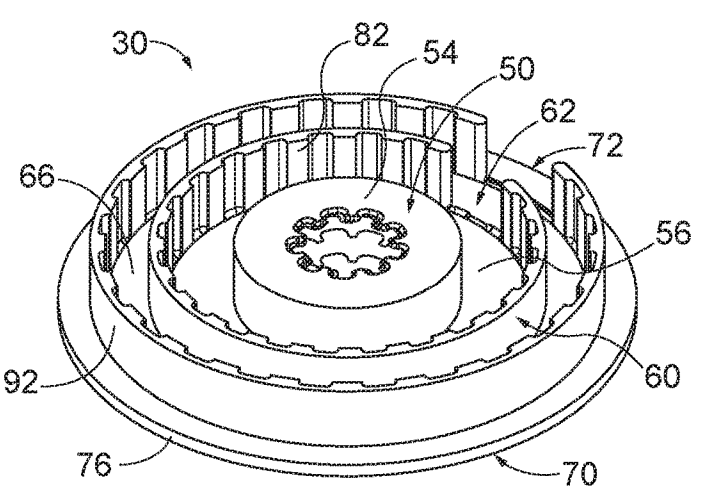
FIG. 29A depicts a top perspective view of the core member of FIG. 3, with the inner roller, the intermediate roller, and the outer roller assembled together.
Figure 30A:
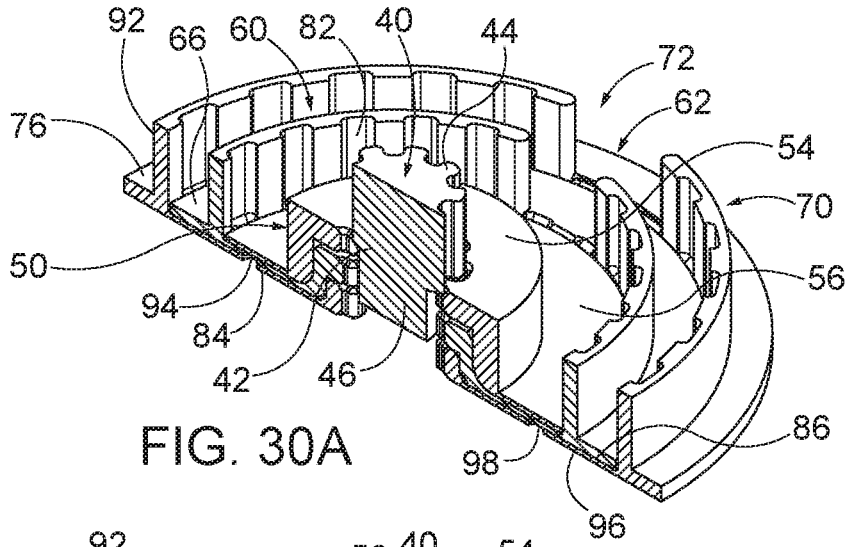
FIG. 30A depicts a cross-sectional view of the core member of FIG. 3, showing the gear in the upper position.

Accordingly, the core member (30) may be assembled, as shown in FIG. 29A, by nesting the core (74) of the outer roller (70) within the core (64) of the intermediate roller (60) and nesting the core (64) of the intermediate roller (60) within the core (54) of the inner roller (50) such that the rollers (50, 60, 70) are concentrically aligned about the longitudinal axis (A). In this assembled position, the discs (56, 66, 76) of the rollers (50, 60, 70) are thereby laterally aligned along the same plane (P), as shown in FIGS. 7-8. For instance, the core (64) of the intermediate roller (60) may be inserted within the lower opening (53) of the inner roller (50) to position the intermediate roller (60) underneath the inner roller (50). In this position, the bottom surface of the disc (56) of the inner roller (50) may be positioned on the top surface of the inner disc (86) of the intermediate roller (60) such that the annular flange (82) of the intermediate roller (60) extends upwardly past the disc (56) of the inner roller (50). The core (74) of the outer roller (70) is then inserted within the lower opening (63) of the intermediate roller (60) to position the outer roller (70) underneath the intermediate roller (60). The bottom surface of the outer disc (66) of the intermediate roller (60) may thereby be positioned on a top surface of the inner disc (96) of the outer roller (70) such that the annular flange (92) of the outer roller (70) extends upwardly past the outer disc (66) of the intermediate roller (60). The outer disc (76) of the outer roller (70) then extends outwardly from the annular flange (92) of the outer roller (90). In the illustrated embodiment, the outer disc (76) of the outer roller (70) is thicker than the other discs (56, 66, 86, 96) such that when the rollers (50, 60, 70) are assembled, the top surfaces of the outer discs (56, 66) of the inner and intermediate rollers (50, 60) are aligned with the top surface of the outer disc (76) of the outer roller (70) along the same plane, as shown in FIG. 30A.

The recesses (62, 72) of the intermediate and outer rollers (60, 70) may also be aligned with each other such that film may be inserted through the recesses (62, 72) to the inner roller (50). The openings (84, 94) of the intermediate and outer rollers (60, 70) may also be aligned with each other such that the first pin may be positioned with both of the openings (84, 94) to selectively prevent rotation of both of the intermediate and outer rollers (60, 70). The second pin may be positioned with the other opening (98) of the outer roller (70) to selectively prevent rotation of only the outer roller (70). The gear (40) may then be positioned through the upper openings (58, 68, 78) of the rollers (50, 60, 70) such that the rollers (50, 60, 70) may be rotated relative to each other to wind and/or unwind film from the core member (30). Still other suitable configurations for the core member (30) will be apparent to one with ordinary skill in the art in view of the teachings herein.

For instance, in some versions, each of the annular flanges (82, 92) of the intermediate and outer rollers (60, 70) may comprise a recess on an interior portion of the annular flanges (82, 92) to receive the outer discs (56, 66) of the respective inner and intermediate rollers (60, 70) to maintain the position of the rollers (50, 60, 70) relative to each other along the axis (A) when the rollers (50, 60, 70) are assembled. Further, while the cores (54, 64, 74), flanges (82, 92), and discs (56, 66, 76, 86, 96) are shown with a circular profile, any other suitable shape may be used (e.g., square, triangular, oval, rectangular, hexagonal, etc.)

II. A Method of Winding a Core Member Comprising a Plurality of Rollers

Figure 29D:
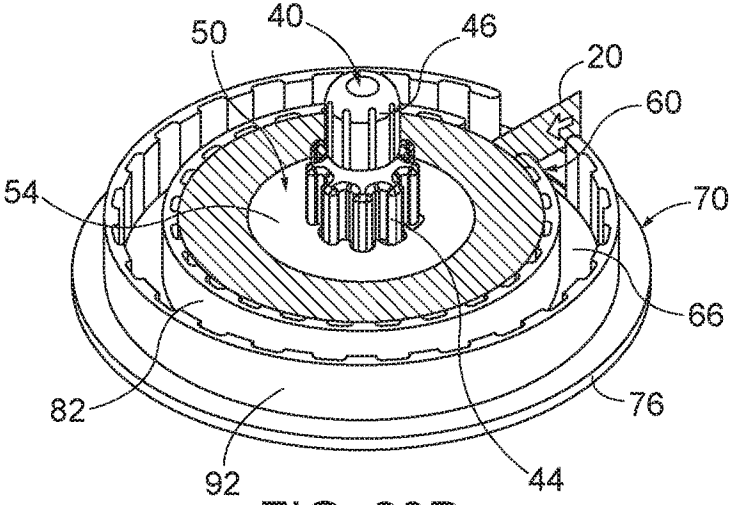
FIG. 29D depicts a top perspective view of the core member of FIG. 29, showing the film wound onto the inner roller and the gear inserted within the inner roller and the intermediate roller in an intermediate position.
Figure 29C:
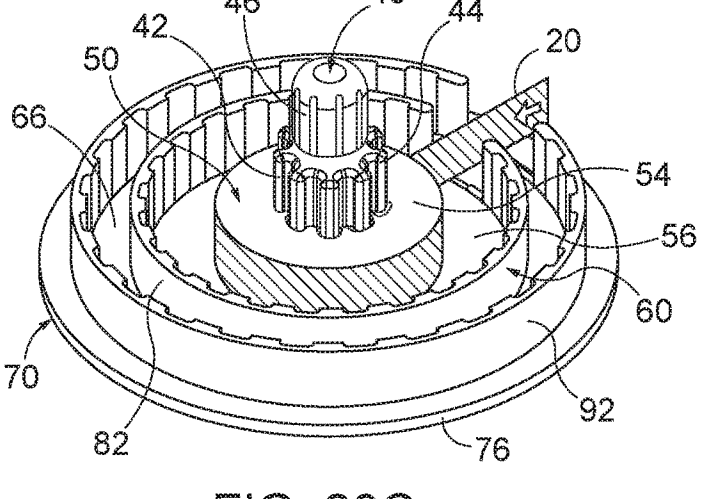
FIG. 29C depicts a top perspective view of the core member of FIG. 29B, showing film being wound onto the inner roller.

With the rollers (50, 60, 70) assembled to form the core member (30), the gear (40) may be positioned within the upper openings (58, 68, 78) of the rollers (50, 60, 70) to wind film onto the core member (30), as shown in FIGS. 29B and 30A. For instance, the gear (40) may be inserted through the top of the upper opening (58) of the inner roller (50) (FIG. 29B), or the gear (40) may be inserted through the bottom of the core member (30) (FIG. 30A), to an upper position such that the teeth (44) of the gear (40) are only engaged with the recesses (57) of the inner roller (50). In this position, the first solenoid may be activated to prevent rotation of both the intermediate roller (60) and the outer roller (70). One end of an elongated sheet of film (20) may then be inserted through the recesses (62, 72) of the intermediate and outer rollers (60, 70) and attached to the outer sidewall surface of the core (54) of the inner roller (50), as shown in FIG. 29C. The gear (40) may then be rotated to thereby rotate only the inner roller (50) to wind the film (20) about the core (54) of the inner roller (50). As the inner roller (50) rotates, the film (20) winds outward onto the disc (56) of the inner roller (50), as shown in FIG. 29D.

Figure 29F:
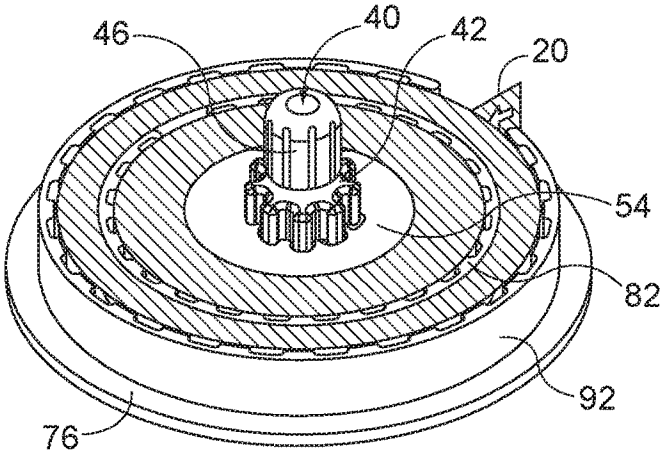
FIG. 29F depicts a top perspective view of the core member of FIG. 29E, showing the film wound onto the intermediate roller and the gear inserted within the inner roller, the intermediate roller, and the outer roller in a lower position.
Figure 29E:
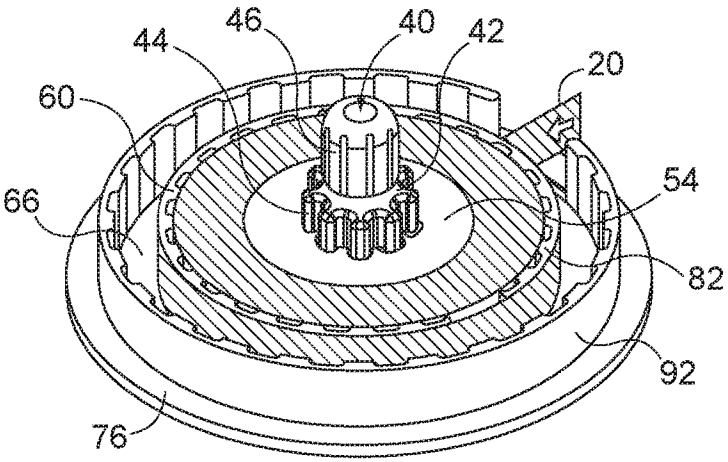
FIG. 29E depicts a top perspective view of the core member of FIG. 29D, showing the film being wound onto the intermediate roller.
Figure 30B:
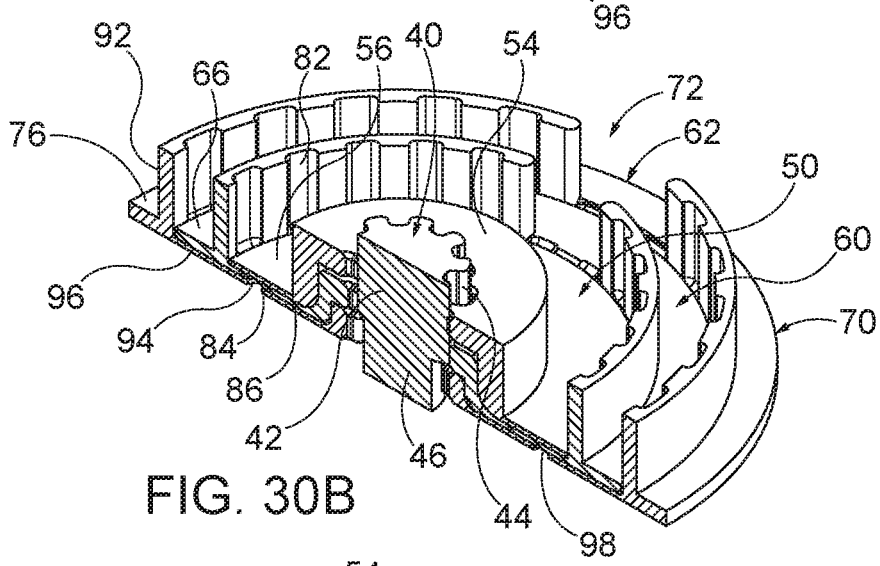
FIG. 30B depicts a cross-sectional view of the core member of FIG. 3, showing the gear in the intermediate position.

Once the film (20) has been wound about the core (54) of the inner roller (50) to the interior surface of the annular flange (82) of the intermediate roller (60), the gear (40) may be lowered to the intermediate position shown in FIGS. 29E and 30B. In the intermediate position, the teeth (44) of the gear (40) are engaged with the recesses (57, 67) of both the inner roller (50) and the intermediate roller (60). The first solenoid may be deactivated and the second solenoid may be activated such that the intermediate roller (60) may be allowed to rotate, but the second solenoid prevents the outer roller (70) from rotating. Accordingly, the same elongated sheet of film (20) may continue to be wound about the core member (30) through the recess (72) of the outer roller (70). As shown FIG. 29F, with the inner roller (50) and intermediate roller (60) rotating together, the film (20) is wound about the outer surface of the annular flange (82) of the intermediate roller (60). As the intermediate roller (60) rotates, the film (20) winds outward onto the outer disc (66) of the intermediate roller (60).

Figure 29H:
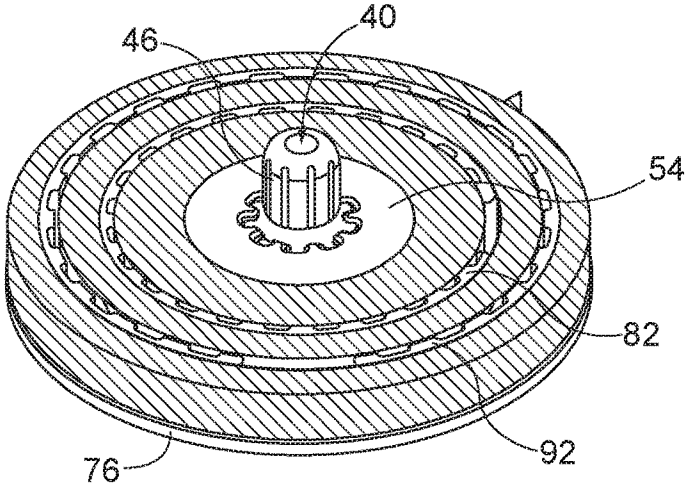
FIG. 29H depicts a top perspective view of the core member of FIG. 29G, showing the film wound onto the outer roller.
Figure 29G:
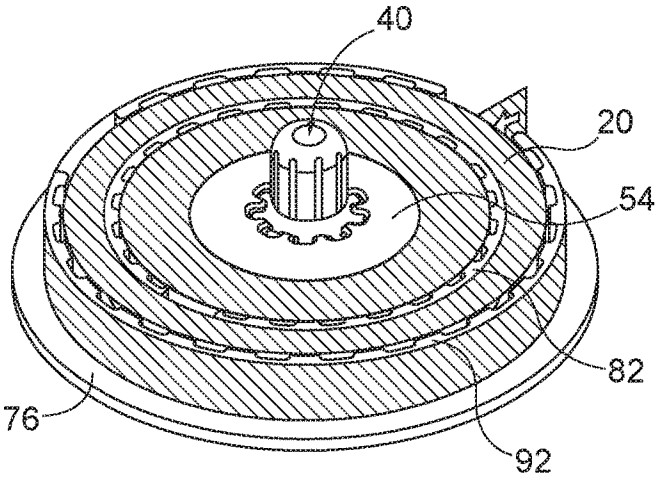
FIG. 29G depicts a top perspective view of the core member of FIG. 29F, showing the film being wound onto the outer roller.
Figure 30C:
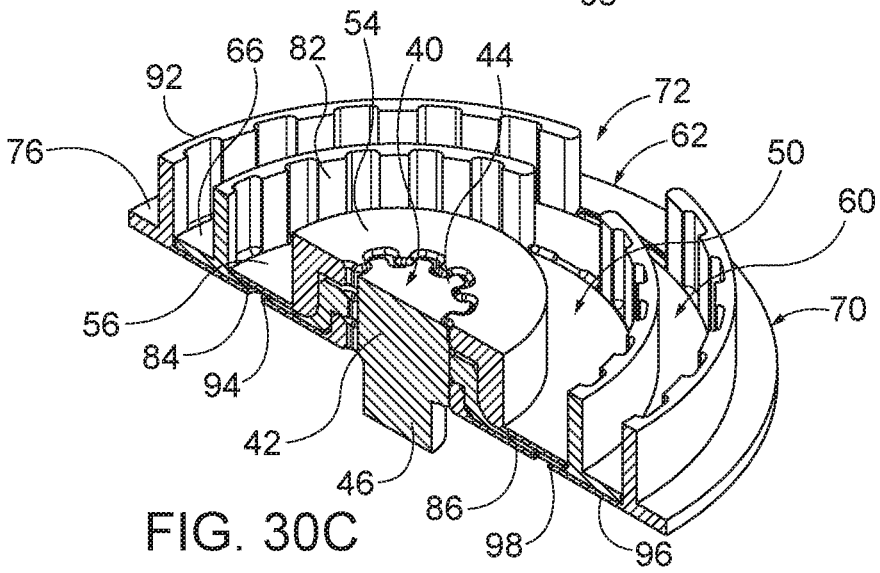
FIG. 30C depicts a cross-sectional view of the core member of FIG. 3, showing the gear in the lower position.
Figure 31:
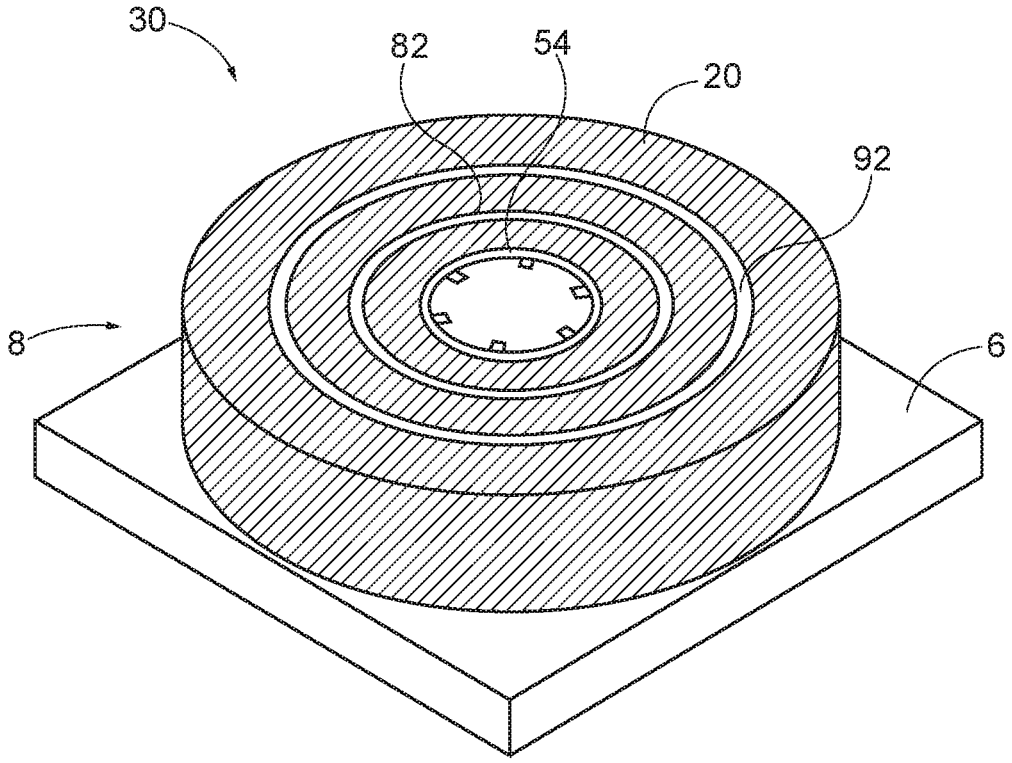
FIG. 31 depicts a top perspective view of the core member of FIG. 3 with an elongated sheet of film wound about the core member and stored on a pallet.
Figure 32:
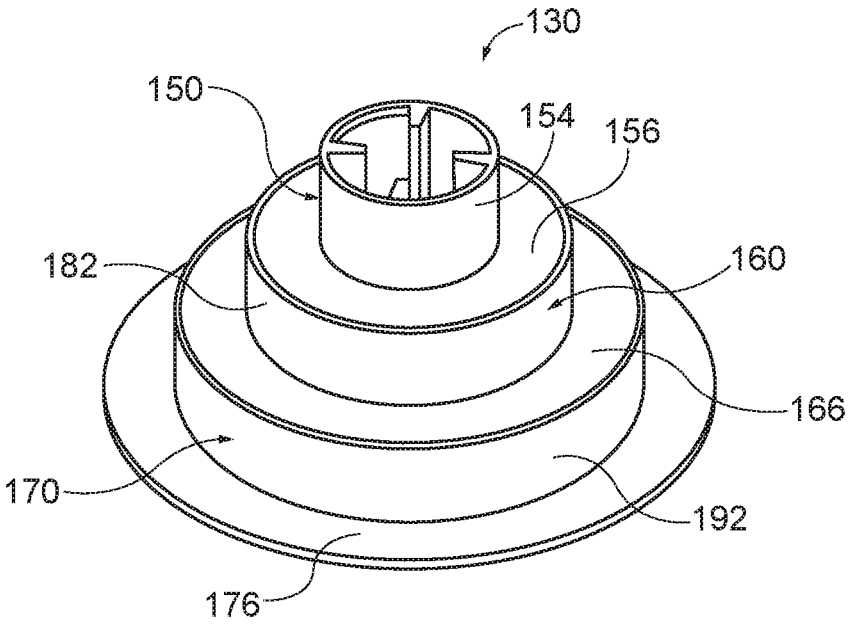
FIG. 32 depicts a top perspective view of another embodiment of a core member comprising a plurality of rollers in a fully expanded position.
Figure 33:
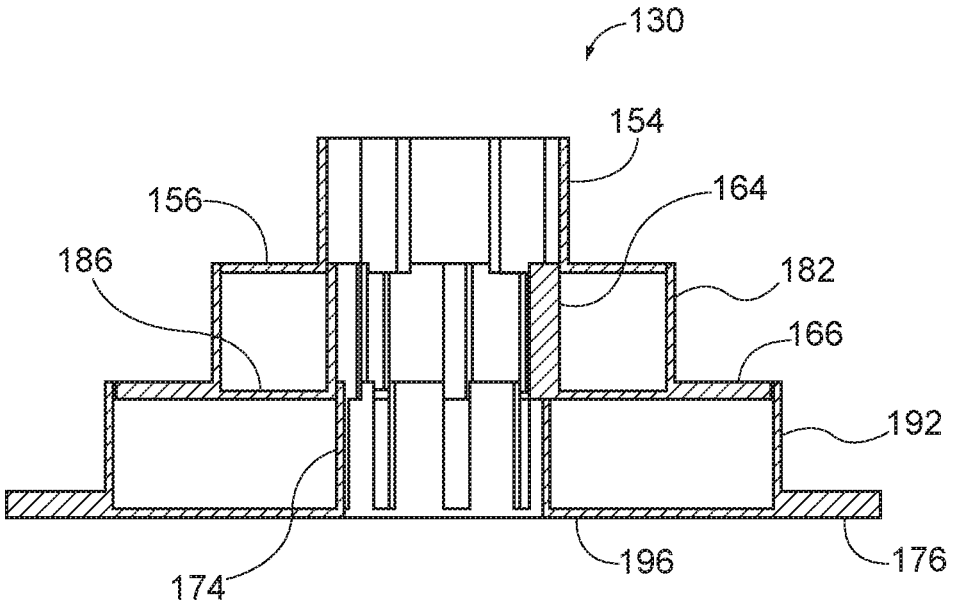
FIG. 33 depicts a cross-sectional view of the core member of FIG. 32.

With the film (20) wound about intermediate roller (60), to the interior surface of the annular flange (92) of the outer roller (70), the gear (40) may be lowered to the lower position shown in FIGS. 29G and 30C. In the lower position, the teeth (44) of the gear (40) are engaged with the recesses (57, 67, 77) of each of the inner roller (50), the intermediate roller (60), and the outer roller (70). The second solenoid may be deactivated such that each of the inner roller (50), the intermediate roller (60), and the outer roller (70) may be allowed to rotate. Accordingly, the same elongated sheet of film (20) may continue to be wound about the outer roller (70) of the core member (30), as shown in FIG. 29G. With each of the rollers (50, 60, 70) simultaneously rotating, the film (20) is wound about the outer surface of the annular flange (92) of the outer roller (70). As the outer roller (70) rotates, the film (20) winds outward onto the outer disc (76) of the outer roller (70), as shown in FIG. 29H. The film (20) may thereby be wound to the outer edge of the outer disc (76) of the outer roller (70). The wound core member (30) may then be placed on a pallet (6), as shown in FIG. 31. Still other suitable configurations for winding the core member (30) will be apparent to one with ordinary skill in the art in view of the teachings herein.

Accordingly, the core member (30) is more efficiently wound with a continuous elongated sheet of film (20) to hold a larger amount of film (20). Because the core member (30) is able to hold a larger amount of film (20), one core member (30) may be used as one layer (8) on a pallet (6). This may allow more meters of film (20) to be transported on one pallet (6). The amount of time to wind the film (20) onto a core member (30) may also be reduced by decreasing the amount of film splices and changeover time to wind the film (20) more efficiently and reduce costs.

The core member (30) may thereby hold up to about 5,500 meters of film (20) per layer (8), which is about 20% to about 30% more film (20) per layer (8). The core member (30) may also hold about 27,500 to about 137,500 meters of film (20) per pallet (6), which is about 130% to about 250 more film (20) per pallet (6). The core member (30) may only require one splice in the film (20) to run about 10,000 meters of film (20). During the winding process, the average rate of speed the film (20) may wind onto a core member (30) may be about 325 meters per minute and the amount of time to wind the film (20) onto the core member (30) may be about 15 minutes. Accordingly, the amount of time to unwind film (20) from a slit roll containing about 10,000 meters of film (20), splice the film (20), and wind the film (20) onto a plurality of core members (30) may be about 28 minutes. The core member (30) thereby allows the film (20) to be wound more efficiently.

Because of the increase in the amount of film (20) the core member (30) is able to hold, a plurality of rollers (50, 60, 70) are used such that the amount of pressure on the film (20) as the film (20) is wound onto the core member (30) may be reduced. For instance, the annular flanges (82, 92) of the intermediate and outer rollers (60, 70) may provide support for the film (20) as the film (20) is wound onto the core member (30) such that the plurality of rollers (50, 60, 70) may prevent the film (20) from retaining a curled shape when the film (20) is unwound from the core member (30), which may prevent the film (20) from being transferred to a bottle. The plurality of rollers (50, 60, 70) of the core member (30) may further provide traceability of sections of the film (20). Accordingly, more than one roller (50, 60, 70) may be used for the core member (30).

III. A Method of Loading a Core Member Comprising a Plurality of Rollers

Figure 39A:
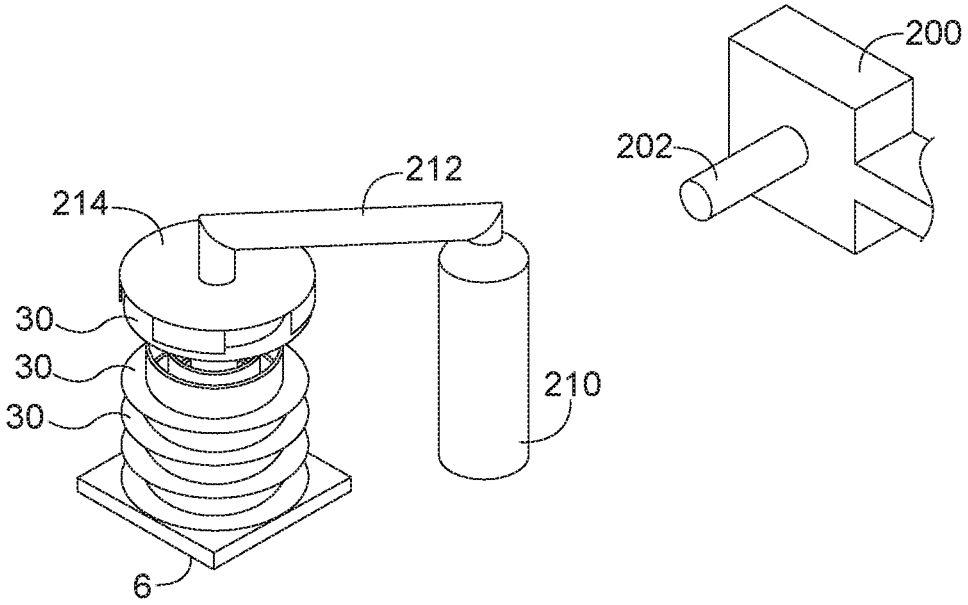
FIG. 39A depicts a schematic of a robot for picking up a core member from a pallet.

In some versions, a robot (210) may be used to more easily and/or efficiently load or unload a core member (30) onto a seamer (200) for winding. In the illustrated embodiment, as shown in FIG. 39A, the robot (210) comprises an arm (212) and a claw (214) positioned at an end of the arm (212). Accordingly, the arm (212) may rotate and/or translate relative to the robot (210) to position the claw (214). In some versions, the robot (210) comprises a motor and/or a control unit to selectively position and/or actuate the claw (214) of the robot (210) to pick up, carry, and/or put down a core member (30) with the claw (214). Still other suitable configurations for the robot (210) will be apparent to one with ordinary skill in the art in view of the teachings herein.

Figure 39B:
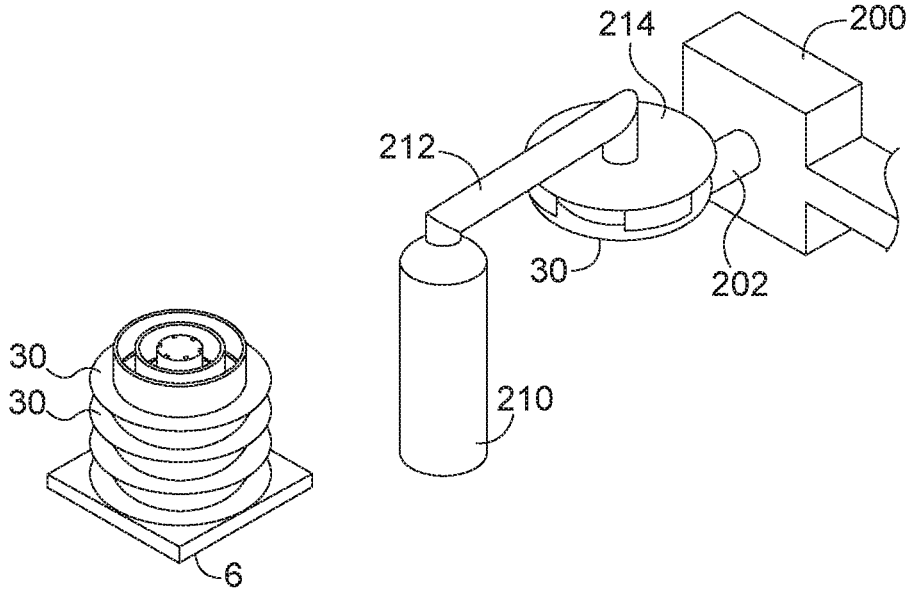
FIG. 39B depicts a schematic of the robot of FIG. 39A loading the core member onto a seamer.
Figure 39C:
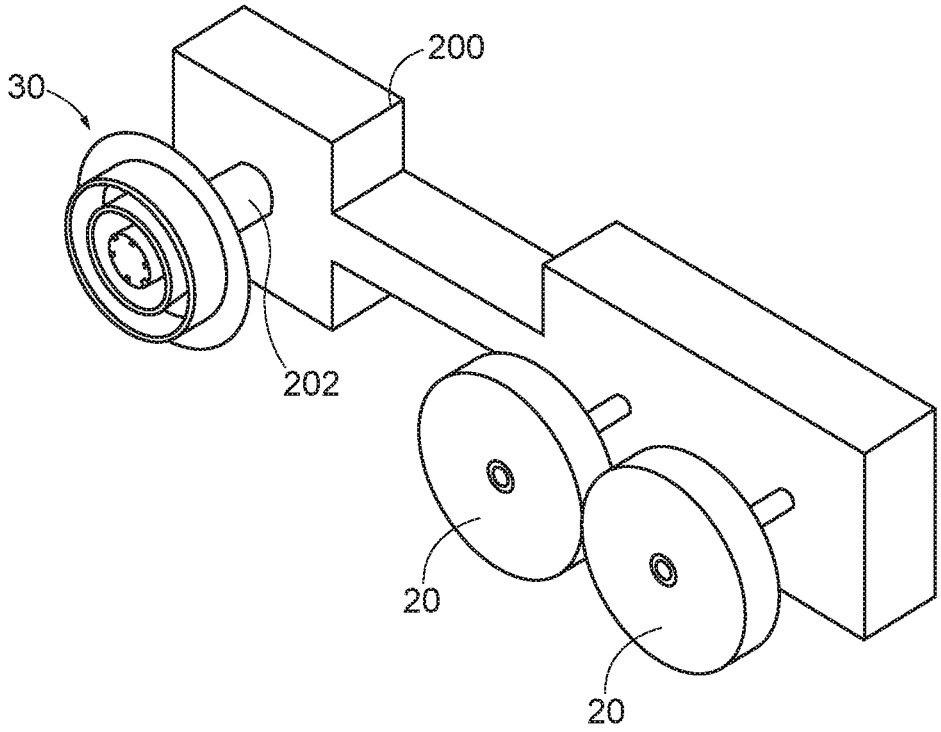
FIG. 39C depicts a schematic of the seamer of FIG. 39B loaded with the core member and rolls of film for rolling onto the core member.

Referring to FIGS. 39A-39C, the robot (210) is shown loading a core member (30) onto a seamer (200) for winding film (20) onto the core member (30). For instance, a plurality of empty core members (30) are stacked on top of each other on a pallet (6). The robot (210) may be used to translate the arm (212) of the robot (210) to position the claw (214) of the robot (210) above the stack of core members (30). The arm (212) of the robot (210) may then be lowered to position the claw (214) on the top core member (30). The claw (214) may then be actuated to grasp the top core member (30) and the arm (212) may be raised to pick up the core member (30), as shown in FIG. 39A. For instance, the claw (214) may grasp the core member (30) from the top, from the side, from the bottom, and/or by a magnet. The arm (212) may then be translated to position the claw (214) adjacent to the seamer (200) as shown in FIG. 39B. The claw (214) may then be actuated to unload the empty core member (30) onto an arm (202) of the seamer (200). The arm (212) can be operated to rotate the claw (214) to position the core member (30) from the vertical position to the horizontal position as shown in FIG. 39C. The film (20) may then be wound onto the core member (30) from the seamer (200) as described above.

Figure 40A:
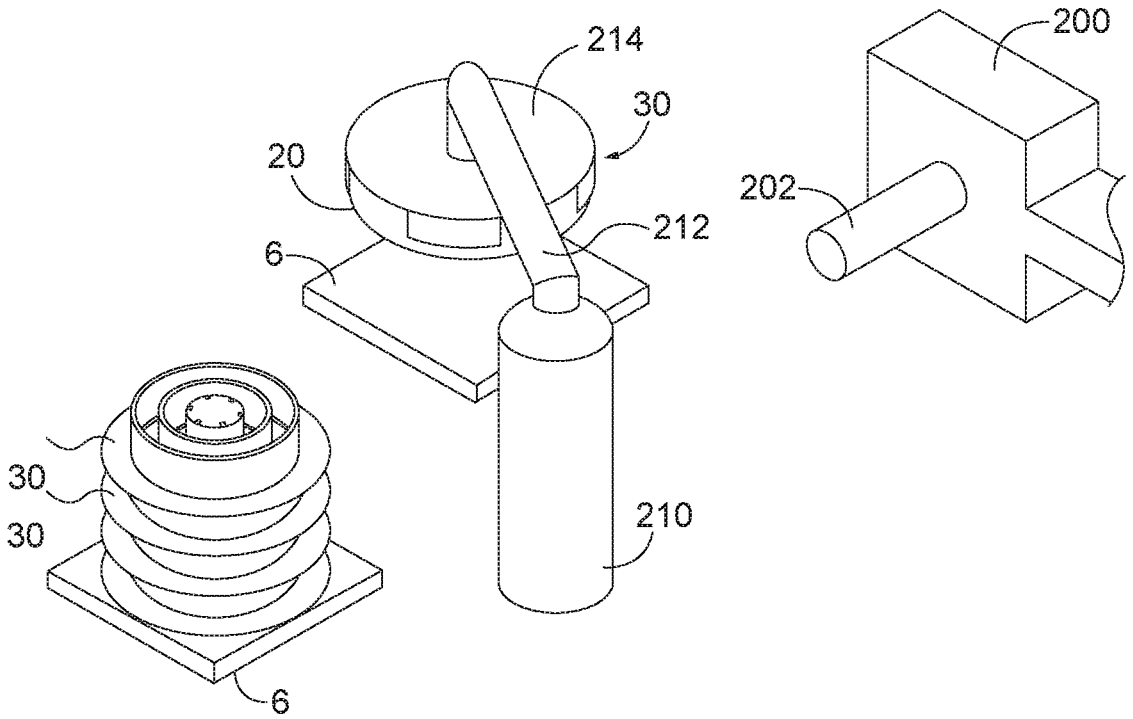
FIG. 40A depicts a schematic of the robot of FIG. 39B, placing the core member onto a pallet.
Figure 40B:
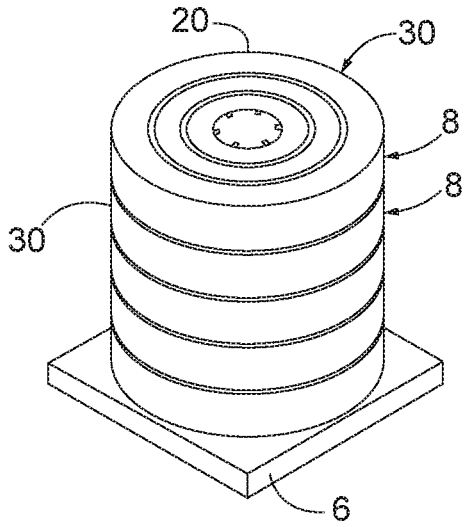
FIG. 40B depicts a schematic of a plurality of core members of FIG. 40A placed onto the pallet.

Once the film (20) is wound onto the core member (30), the robot (210) may be used to place the wound core member (30) onto another pallet (6), as shown in FIGS. 40A-40B. For instance, the robot (210) may be actuated to position the claw (214) adjacent to the wound core member (30) to grasp the wound core member (30) on the seamer (200). The arm (212) may then be translated to position the claw (214) above the pallet (6), as shown in FIG. 40A. The arm (212) may then be lowered and the claw (214) may be actuated to unload the wound core member (30) onto the pallet (6). This process may be repeated to stack additional wound core members (30) on top of each other on the pallet (6) to form layers (8), as shown in FIG. 40B. The stacked pallet (6) of wound core members (130) may then be more easily transported to a customer. Still other suitable configurations for loading and/or unloading a core member (30) will be apparent to one with ordinary skill in the art in view of the teachings herein.

IV. A Method of Unwinding a Core Member Comprising a Plurality of Rollers

Figure 41A:
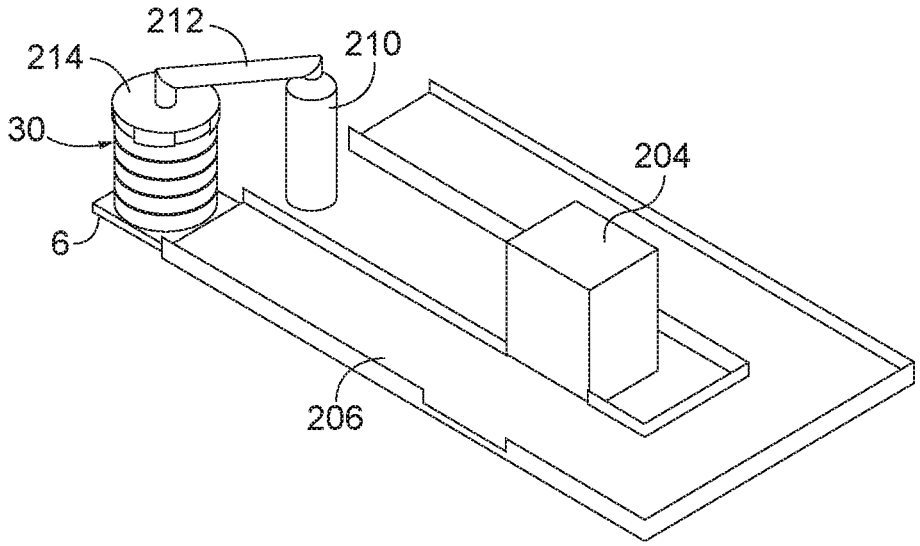
FIG. 41A depicts a schematic of the robot of FIG. 39A placing the core member onto a conveyor.
Figure 41B:
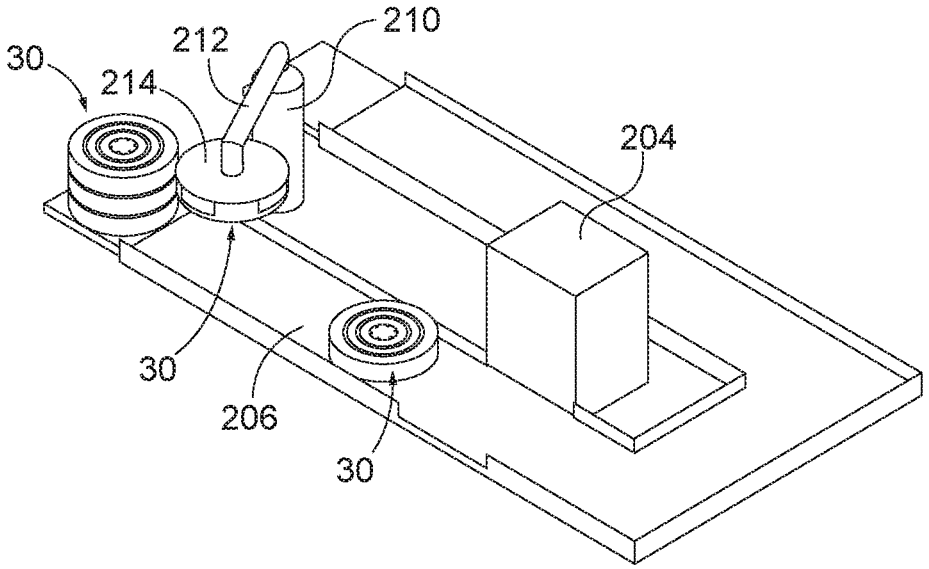
FIG. 41B depicts a schematic of the core member being transported along the conveyor of FIG. 41A to an unwinder.
Figure 41C:
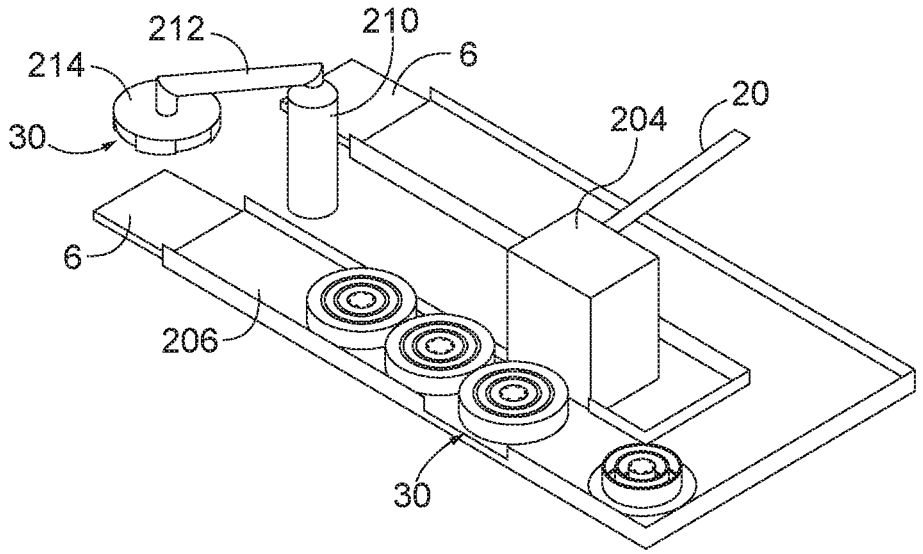
FIG. 41C depicts a schematic of film on the core member of FIG. 41B being unwound by the unwinder.
Figure 41D:
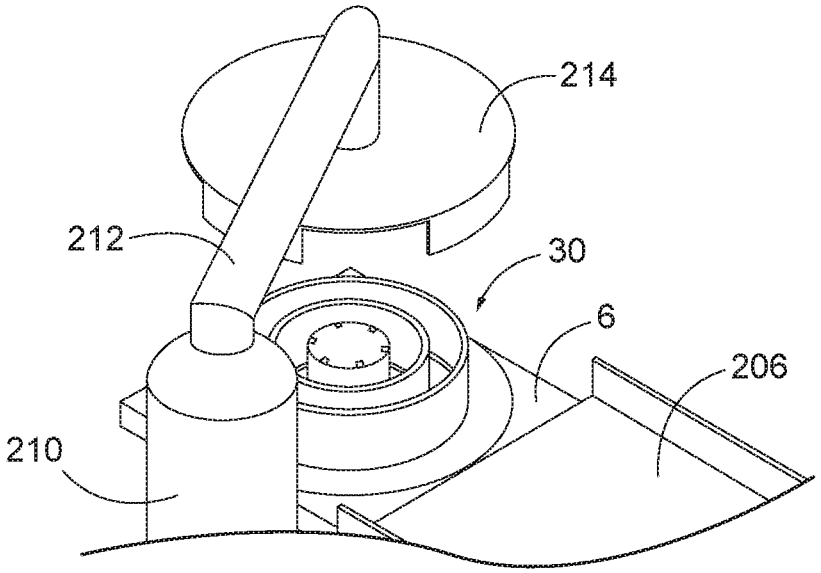
FIG. 41D depicts a schematic of the core member of FIG. 41C being placed on a pallet by the robot.

Referring to FIGS. 41A-41D, the film (20) on the wound core member (30) may then be unwound and removed from the core member (30) such as by a customer. For instance, the robot (210) described above may be used to remove the wound core member (30) from the pallet (6) for unwinding. The arm (212) of the robot (210) may be actuated to position the claw (214) of the robot (210) adjacent to the wound core member (30) to grasp the wound core member (30) from the stacked pallet (6) as shown in FIG. 41A. The arm (212) of the robot (210) may then be translated to position the claw (214) above a conveyor (206) such that the claw (214) may place the wound core member (30) onto the conveyor (206). The conveyor (206) may then transport the wound core member (30) to an unwinder (204) as shown in FIG. 41B. The unwinder (204) may then unwind the film (20) from the core member (30), as shown in FIG. 41C, for use by the customer. For instance, an end of the film (20) may be loaded into the unwinder (204) from the outer roller (70). The unwinder (204) may then unwind the film (20) from the core member (30) in an opposite manner as described above by rotating the core member (30) to remove the film (20) from the outer roller (70), then the intermediate roller (60), and then the inner roller (50). Once the film (20) is unwound from the core member (30), the conveyor (206) may transport the empty core member (30) to the robot (210) such that the robot (210) may place the empty core member (30) onto a pallet (6) with the claw (214), as shown in FIG. 41D. Still other suitable methods for unwinding the core member (30) will be apparent to one with ordinary skill in the art in view of the teachings herein.

IV. A CORE MEMBER COMPRISING A PLURALITY OF EXPANDABLE ROLLERS

Another embodiment of a core member (130), shown in FIGS. 32-37, is similar to the core member (30) described above, except that the core member (130) is expandable. For instance, referring to FIGS. 32-33, the core member (130) is shown in a fully expanded position with the inner roller (150) extending upward from the intermediate roller (160), which is extending upward from the outer roller (170). Accordingly, the outer disc (156) of the inner roller (150) is positioned at a top portion of the core (164) and annular flange (182) of the intermediate roller (160). The outer disc (166) is positioned at a top portion of the core (174) and annular flange (192) of the outer roller. In this fully expanded position, one end of the film (20) may be attached to a sidewall of the core (154) of the inner roller (150), as shown in FIG. 38A. The inner roller (150) may then be rotated to wind the film (20) onto the inner roller (150) in this expanded position as shown in FIG. 38B. The film (20) is thereby wound onto the inner roller (150) such that the film (20) expands on the outer disc (156) of the inner roller (150). The inner roller (150) may rotate relative to the intermediate roller (160) and the outer roller (170) or the intermediate roller (160) and/or the outer roller (170) may rotate with the inner roller (150) when the film (20) is wound onto the inner roller (150).

Figure 34:
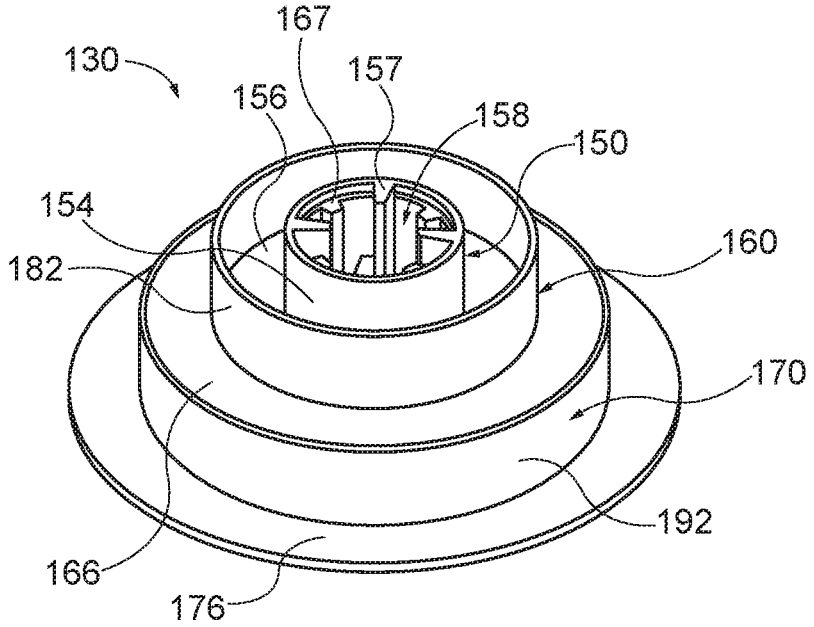
FIG. 34 depicts a top perspective view of the core member of FIG. 32 in a partially expanded position.
Figure 35:
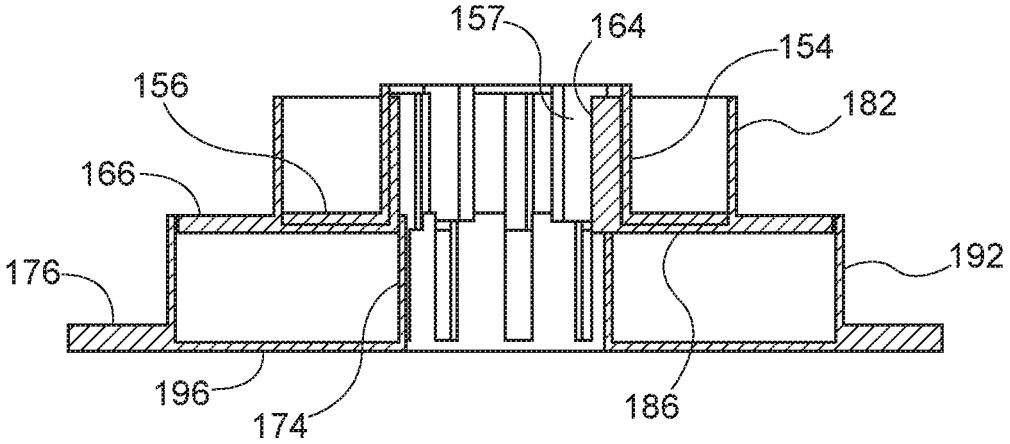
FIG. 35 depicts a cross-sectional view of the core member of FIG. 34.
Figure 38B:
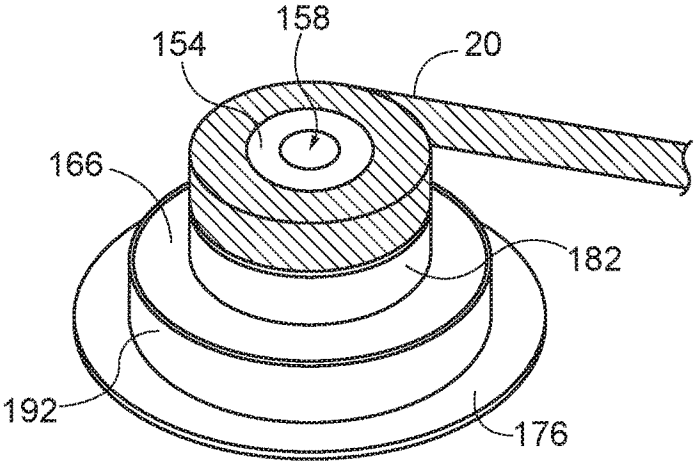
FIG. 38B depicts a top perspective view of the core member of FIG. 38A in the fully expanded position with film wound around the inner roller.
Figure 38D:
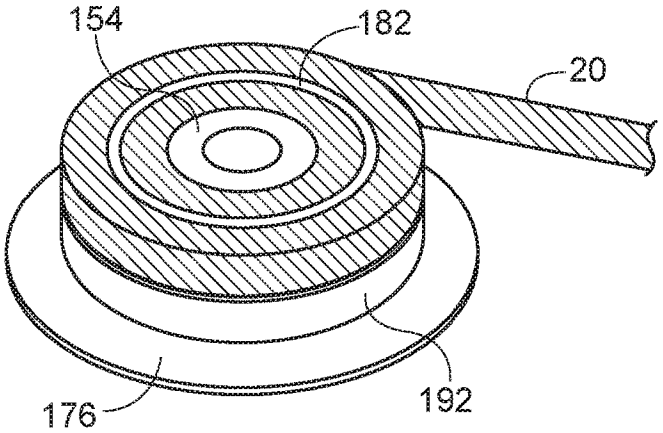
FIG. 38D depicts a top perspective view of the core member of FIG. 38C in the partially expanded position with film wound around an intermediate roller.
Figure 38A:
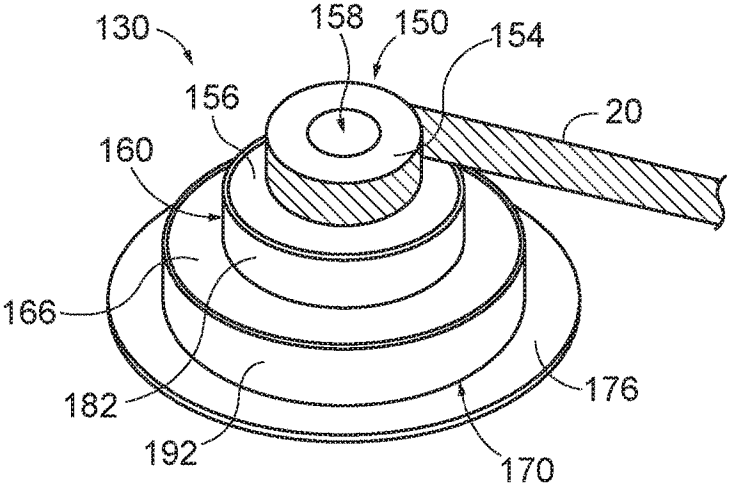
FIG. 38A depicts a top perspective view of the core member of FIG. 32 in the fully expanded position with film being positioned on an inner roller.
Figure 38C:
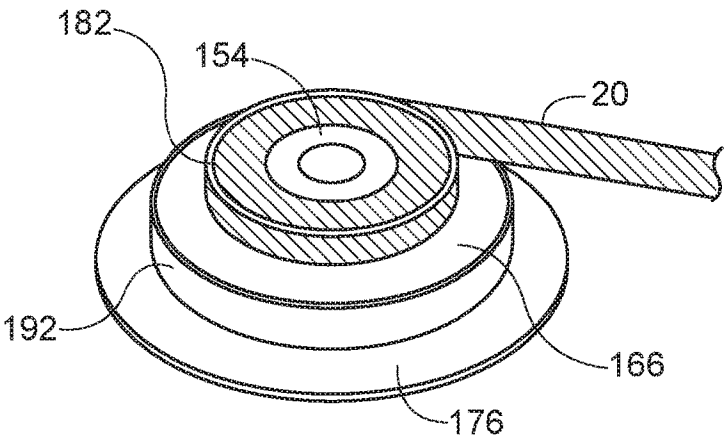
FIG. 38C depicts a top perspective view of the core member of FIG. 38B in a partially expanded position with film wound around the inner roller.

Once the film (20) is wound around the inner roller (150) until the outer diameter of the wound film around the inner roller (150) is slightly smaller than the inner diameter of the annular flange (182) of the intermediate roller (160), the core member (130) may be lowered into a partially expanded position, as shown in FIGS. 34-35, such that the inner roller (150) is nested within the intermediate roller (160). In this position, the core (154) of the inner roller (150) surrounds the core (164) of the intermediate roller (160). The core (164) of the intermediate roller (160) may comprise recesses to receive the teeth (157) of the core (154) of the inner roller (150). When the teeth (157) of the core (154) of the inner roller (150) is inserted through the recess, the core member (130) can be lowered into the partially expanded position. The teeth (157) may thereby maintain the position of the inner roller (150) with the intermediate roller (160) to simultaneously rotate the inner roller (150) with the intermediate roller (160). The outer disc (156) of the inner roller (150) may then be positioned on the inner disc (186) of the intermediate roller (160). The intermediate roller (160) may then be rotated to continue winding the film (20) onto the intermediate roller (160) in this partially expanded position as shown in FIG. 38C. The film (20) is thereby wound onto the intermediate roller (160) such that the film (20) expands on the outer disc (166) of the intermediate roller (160), as shown in FIG. 38D.

Figure 36:
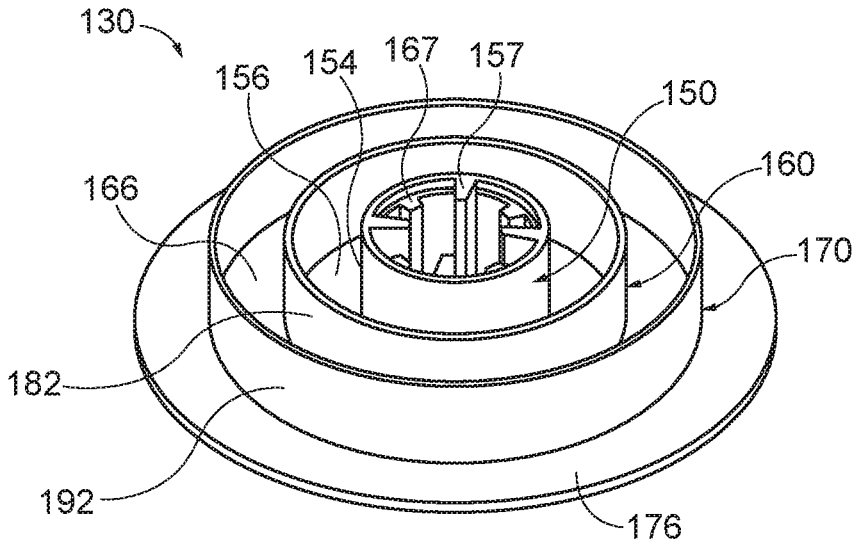
FIG. 36 depicts a top perspective view of the core member of FIG. 32 in a collapsed position.
Figure 37:
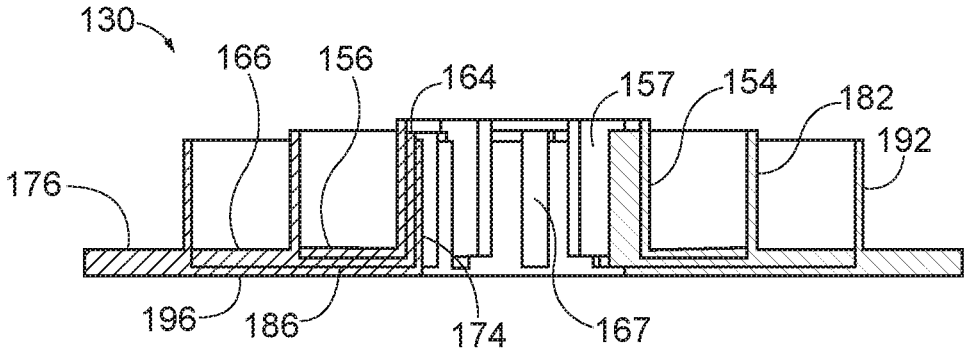
FIG. 37 depicts a cross-sectional view of the core member of FIG. 36.
Figure 38E:
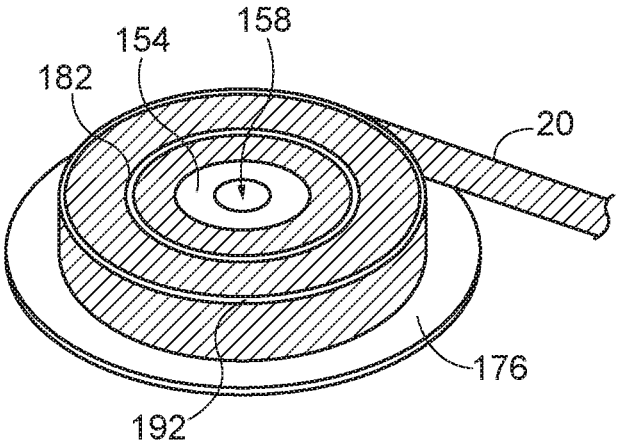
FIG. 38E depicts a top perspective view of the core member of FIG. 38D in a collapsed position with film wound around the intermediate roller.
Figure 38F:
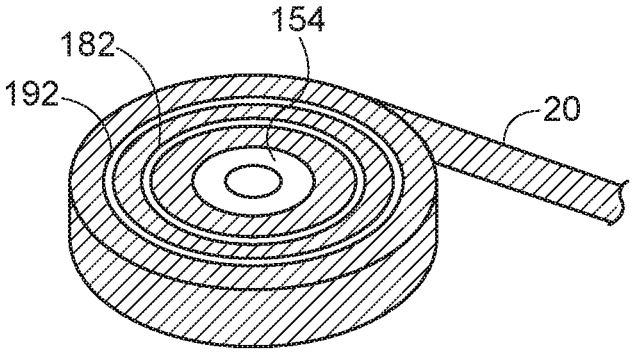
FIG. 38F depicts a top perspective view of the core member of FIG. 38E in the collapsed position with film wound around an outer roller.

Once the film (20) is wound around the intermediate roller (160) until the outer diameter of the wound film around the intermediate roller (160) is slightly smaller than the inner diameter of the annular flange (192) of the outer roller (170), the core member (130) may be lowered into a collapsed position, as shown in FIGS. 36-37, such that the inner roller (150) is nested within the intermediate roller (160) and the intermediate roller (160) is nested within the outer roller (170). In this position, the core (154) of the inner roller (150) surrounds the core (164) of the intermediate roller (160) and the core (164) of the intermediate roller (160) surrounds the core (174) of the outer roller (174). The core (174) of the outer roller (170) may comprise recesses to receive the teeth (157) of the core (154) of the inner roller (150) and the teeth (167) of the core (164) of the intermediate roller (160). When the teeth (157, 167) of the core (154, 164) are inserted through the recesses, the core member (130) can be lowered into the collapsed position. The teeth (157, 167) may thereby cause the rollers (150, 160, 170) to simultaneously rotate with each other. The outer disc (166) of the intermediate roller (160) may then be positioned on the inner disc (196) of the outer roller (170). The outer roller (170) may then be rotated to continue winding the film (20) onto the outer roller (170) in this collapsed position as shown in FIG. 38E. The film (20) is thereby wound onto the outer roller (170) such that the film (20) expands on the outer disc (176) of the outer roller (170), as shown in FIG. 38F. Still other suitable configurations for the expandable core member (130) will be apparent to one with ordinary skill in the art in view of the teachings herein.

V. A CORE MEMBER COMPRISING A COLLAPSIBLE ROLLER

Figure 42A:
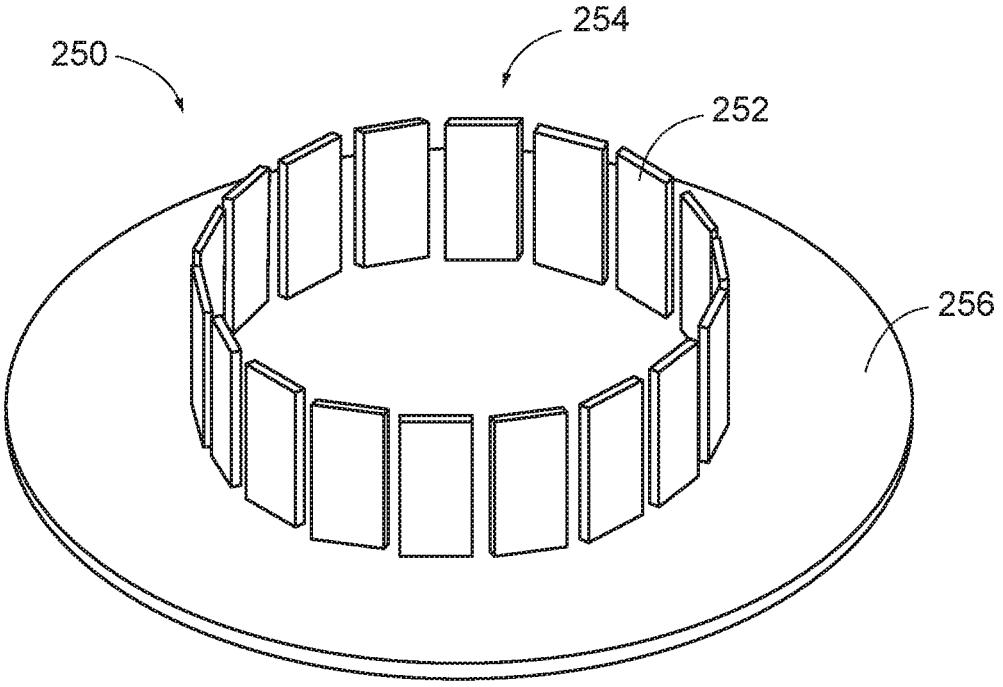
FIG. 42A depicts a top perspective view of an embodiment of a roller for use with a core member.
Figure 42B:
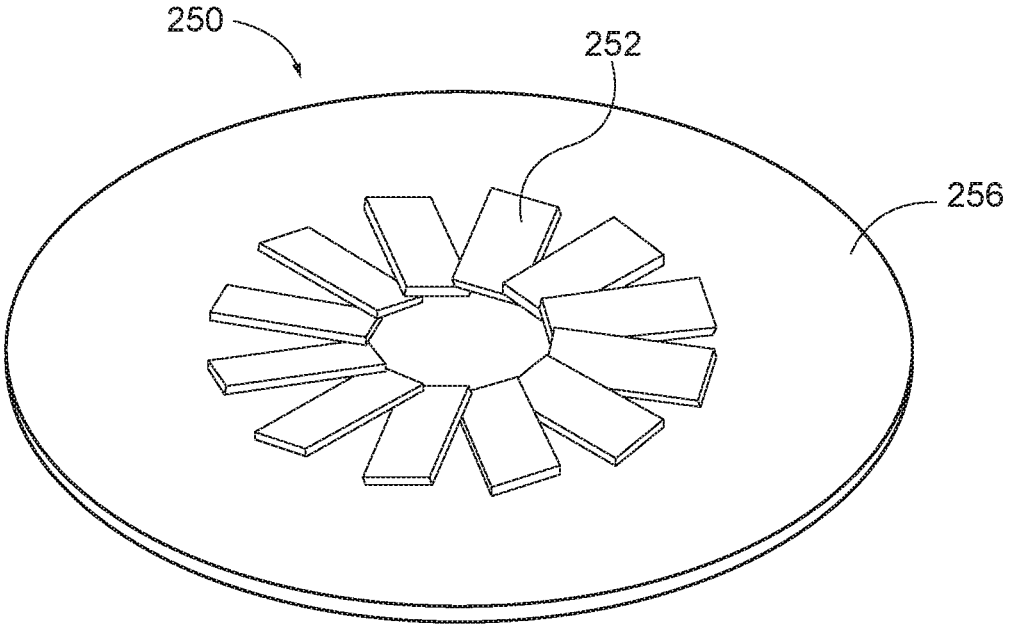
FIG. 42B depicts a top perspective view of the roller of FIG. 41A in a collapsed position.

FIGS. 42A-42B show an embodiment of a roller (250) that may be used with any of the core members (30, 130) described above. In the illustrated embodiment, the roller (250) comprises a disc (256) and a core (254) coupled with the disc (256). The core (254) comprises a plurality of fins (252). In an extended position, as shown in FIG. 42A, the fins (252) are upright such that the fins (252) are extending upwardly from the disc (256) in a circular profile. In a collapsed position, as shown in FIG. 42B, the fins (252) are collapsed such that the fins (252) are bent inwardly to lay on a top surface of the disc (256). The fins (252) can be bent outwardly to lay on the top surface of the disc (256). Accordingly, the roller (250) may be wound and/or unwound with film while the roller (250) is in the extended position. Once the film is removed from the roller (250), the fins (252) may be collapsed to the collapsed position to thereby decrease the volume of the roller (250). This may allow the roller (250) to be more easily transportable. Still other suitable configurations for a collapsible roller (250) will be apparent to one with ordinary skill in the art in view of the teachings herein. For instance, in some versions, the core of a roller may be disposable. In some other versions, the core member may comprise any suitable number of rollers, such as two rollers or four or more rollers.

VI. Examples

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

EXAMPLES

Example 1

A core member for storing a film strip, the core member comprising a plurality of rollers, wherein each roller of the plurality of rollers comprises a disc and a core extending upwardly from the disc, wherein the plurality of rollers are concentrically aligned such that the core of each roller is longitudinally aligned along an axis and the disc of each roller is laterally aligned along a plane.

Example 2

The core member of example 1, wherein each roller of the plurality of rollers is rotatable about the axis to wind film about an exterior side wall of the core such that the film is expandable onto a top surface of the disc.

Example 3

The core member of example 1 or 2, wherein each roller is rotatable relative to the other rollers of the plurality of rollers about the axis.

Example 4

The core member of example 2 or 3, wherein the core of each roller comprises an upper opening configured to receive a gear to rotate the roller, wherein the upper opening comprises a plurality of recesses configured to receive a plurality of teeth of the gear.

Example 5

The core member of any of the examples 1 to 4, wherein the core of at least one roller comprises a lower opening configured to receive the core of another roller.

Example 6

The core member of any of the examples 1 to 5, wherein at least one roller comprises an annular flange extending upwardly from the disc outward of the core to define an inner disc between the core and the annular flange.

Example 7

The core member of example 6, wherein a thickness of the inner disc is smaller than a thickness of the disc extending outward from the annular flange.

Example 8

The core member of examples 6 or 7, wherein the annular flange comprises a recess through a sidewall of the annular flange such that the recess is configured to receive film through the recess.

Example 9

The core member of examples 6, 7, or 8, wherein the annular flange comprises a plurality of teeth.

Example 10

The core member of any of the examples 1 to 9, wherein the disc of at least one roller comprises an opening configured to receive a stopping device, wherein the stopping device is configured to selectively prevent rotation of the at least one roller about the axis.

Example 11

The core member of example 10, wherein the stopping device is a pin or a solenoid.

Example 12

The core member of any of the examples 1 to 11, wherein at least one roller of the plurality of rollers is translatable relative to the other rollers along the axis such that the core member is expandable.

Example 13

The core member of any of the examples 1 to 12, wherein the core of at least one roller is collapsible.

Example 14

The core member of example 13, wherein the core comprises a plurality of fins, wherein the plurality of fins are collapsible onto a top surface of the disc.

Example 15

A core member for storing a film strip, the core member comprising:

(a) an inner roller comprising a first core and a first outer disc extending outwardly from a bottom portion of the first core;

(b) an intermediate roller comprising a second core, a first inner disc extending outwardly from a bottom portion of the second core, a first annular flange extending upwardly from the first inner disc, and a second outer disc extending outwardly from a bottom portion of the first annular flange; and (c) an outer roller comprising a third core, a second inner disc extending outwardly from a bottom portion of the third core, a second annular flange extending upwardly from the second inner disc, and a third outer disc extending outwardly from a bottom portion of the second annular flange;

wherein the inner roller, the intermediate roller, and the outer roller are concentrically aligned along a longitudinal axis;

wherein the third core of the outer roller is insertable within the second core of the intermediate roller such that the second outer disc of the intermediate roller is positioned adjacent to the second inner disc of the outer roller within the second annular flange;

wherein the second core of the intermediate roller is insertable within the first core of the inner roller such that the first outer disc of the inner roller is positioned adjacent to the first inner disc of the intermediate roller within the first annular flange.

Example 16

The core member of example 15, wherein the first annular flange and the second annular flange each comprise a recess, wherein the recesses of the first annular flange and the second annular flange are aligned for inserting film through the recesses.

Example 17

The core member of examples 15 or 16, wherein the first core, the second core, and the third core each comprise a recess, wherein the recesses of the first core, the second core, and the third core are aligned for receiving a gear through the recesses.

Example 18

The core member of any of the examples 15 to 17, wherein a top surface of the first outer disc, the second outer disc, and the third outer disc are aligned along the same plane.

Example 19

A method of winding film onto a core member comprising the steps of:

(a) assembling an outer roller of the core member within an inner roller of the core member such that the outer roller and inner roller are concentrically aligned along a longitudinal axis and laterally aligned along a plane;

(b) rotating the inner roller to wind film about a core of the inner roller; and (c) rotating the outer roller to continuously wind film from the inner roller about a core of the outer roller.

Example 20

The method of example 19, wherein the outer roller is prevented from rotating while the inner roller is rotated.

Example 21

The method of example 19 or 20, wherein the outer roller comprises an annular flange defining a recess, wherein film is inserted through the recess of the annular flange to the inner roller.

Example 22

The method of example 21, wherein film is wound about the inner roller until the film is adjacent to an interior surface of the annular flange of the outer roller, wherein the film is then wound about an exterior surface of the annular flange of the outer roller.

Example 23

The method of any of the examples 19 to 22, wherein, after the core member is wound with film, the core member is stacked on a pallet.

Example 24

The method of example 23, wherein the core member is stacked using a robot.

Example 25

The method of any of the examples 19 to 24, further comprising assembling an intermediate roller between the inner and outer rollers.

Example 26

A method of winding film onto a core member comprising the steps of:

(a) assembling a core of an outer roller into a core of an intermediate roller and assembling the core of the intermediate roller into a core of an inner roller;
(b) rotating the inner roller to wind film about the core of the inner roller until the film is adjacent to an interior surface of an annular flange of the intermediate roller;
(c) rotating the intermediate roller to continuously wind the film about an exterior surface of the annular flange of the intermediate roller until the film is adjacent to an interior surface of an annular flange of the outer roller; and
(d) rotating the outer roller to continuously wind the film about an exterior surface of the annular flange of the outer roller.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

I claim:

1. A core member for storing shrink film, the core member comprising a plurality of rollers, wherein each roller of the plurality of rollers comprises a disc and a core extending upwardly from the disc, wherein the plurality of rollers are concentrically aligned such that the core of each roller is longitudinally aligned along an axis and the disc of each roller is laterally aligned along a plane, wherein at least one roller comprises an annular flange extending upwardly from the disc outward of the core to define an inner disc between the core and the annular flange.

2. The core member of claim 1, wherein each roller of the plurality of rollers is rotatable about the axis to wind film about an exterior side wall of the core such that the film is expandable onto a top surface of the disc.

3. The core member of claim 2, wherein each roller is rotatable relative to the other rollers of the plurality of rollers about the axis.

4. The core member of claim 2, wherein the core of each roller comprises an upper opening configured to receive a gear to rotate the roller, wherein the upper opening comprises a plurality of recesses configured to receive a plurality of teeth of the gear.

5. The core member of claim 1, wherein the core of at least one roller comprises a lower opening configured to receive the core of another roller.

6. The core member of claim 1, wherein a thickness of the inner disc is smaller than a thickness of the disc extending outward from the annular flange.

7. The core member of claim 1, wherein the annular flange comprises a recess through a sidewall of the annular flange such that the recess is configured to receive film through the recess.

8. The core member of claim 1, wherein the annular flange comprises a plurality of teeth extending inward from the annular flange.

9. The core member of claim 1, wherein the disc of at least one roller comprises an opening configured to receive a pin, wherein the pin is configured to selectively prevent rotation of the at least one roller about the axis.

10. The core member of claim 1, wherein at least one roller of the plurality of rollers is translatable relative to the other rollers along the axis.

11. A core member for storing shrink film, the core member comprising:

(a) an inner roller comprising a first core and a first outer disc extending outwardly from a bottom portion of the first core;
(b) an intermediate roller comprising a second core, a first inner disc extending outwardly from a bottom portion of the second core, a first annular flange extending upwardly from the first inner disc, and a second outer disc extending outwardly from a bottom portion of the first annular flange; and
(c) an outer roller comprising a third core, a second inner disc extending outwardly from a bottom portion of the third core, a second annular flange extending upwardly from the second inner disc, and a third outer disc extending outwardly from a bottom portion of the second annular flange;

wherein the inner roller, the intermediate roller, and the outer roller are concentrically aligned along a longitudinal axis;

wherein the third core of the outer roller is insertable within the second core of the intermediate roller such that the second outer disc of the intermediate roller is positioned adjacent to the second inner disc of the outer roller within the second annular flange;

wherein the second core of the intermediate roller is insertable within the first core of the inner roller such that the first outer disc of the inner roller is positioned adjacent to the first inner disc of the intermediate roller within the first annular flange.

12. The core member of claim 11, wherein the first annular flange and the second annular flange each comprise a recess, wherein the recesses of the first annular flange and the second annular flange are aligned for inserting film through the recesses.

13. The core member of claim 11, wherein the first core, the second core, and the third core each comprise a recess, wherein the recesses of the first core, the second core, and the third core are aligned for receiving a gear through the recesses.

14. The core member of claim 11, wherein a top surface of the first outer disc, the second outer disc, and the third outer disc are aligned along the same plane.

15. A method of winding film onto a core member comprising the steps of:

(a) assembling an outer roller of the core member within an inner roller of the core member such that the outer roller and inner roller are concentrically aligned along a longitudinal axis and laterally aligned along a plane, wherein the outer roller comprises an annular flange defining a recess, wherein film is inserted through the recess of the annular flange to the inner roller;

(b) rotating the inner roller to wind film about a core of the inner roller; and (c) rotating the outer roller to continuously wind film from the inner roller about a core of the outer roller.

16. The method of claim 15, wherein the outer roller is prevented from rotating while the inner roller is rotated.

17. The method of claim 15, wherein film is wound about the inner roller until the film is adjacent to an interior surface of the annular flange of the outer roller, wherein the film is then wound about an exterior surface of the annular flange of the outer roller.

18. The method of claim 15, wherein, after the core member is wound with film, the core member is stacked on a pallet.

* * * * *